US008766807B2

(12) United States Patent
Gonzales

(10) Patent No.: US 8,766,807 B2
(45) Date of Patent: Jul. 1, 2014

(54) DYNAMIC ALARM SENSITIVITY ADJUSTMENT AND AUTO-CALIBRATING SMOKE DETECTION

(75) Inventor: Eric V. Gonzales, Aurora, IL (US)

(73) Assignee: Universal Security Instruments, Inc., Owings Mills, MD (US)

( * ) Notice: Subject to any disclaimer, the term of this patent is extended or adjusted under 35 U.S.C. 154(b) by 944 days.

(21) Appl. No.: 12/895,290

(22) Filed: Sep. 30, 2010

(65) Prior Publication Data

US 2011/0018726 A1 Jan. 27, 2011

Related U.S. Application Data

(63) Continuation-in-part of application No. 12/572,707, filed on Oct. 2, 2009, now Pat. No. 8,284,065.

(60) Provisional application No. 61/102,478, filed on Oct. 3, 2008.

(51) Int. Cl.
*G08B 21/00* (2006.01)

(52) U.S. Cl.
USPC ..... 340/628; 340/629; 340/632; 340/636.14

(58) Field of Classification Search
USPC ..... 340/628, 629, 632, 636.14
See application file for complete search history.

(56) References Cited

U.S. PATENT DOCUMENTS 5,117,219 A 5/1992 Tice et al.
5,260,687 A * 11/1993 Yamauchi et al. ..... 340/522
5,369,397 A * 11/1994 Wong ..... 340/632
5,376,924 A 12/1994 Kubo et al.
5,530,433 A 6/1996 Morita
5,539,389 A 7/1996 Bystrak et al.
5,543,777 A 8/1996 Vane et al.
5,546,074 A 8/1996 Bernal et al.
5,552,765 A 9/1996 Vane et al.
5,557,262 A 9/1996 Tice
5,612,674 A 3/1997 Tice
5,627,515 A 5/1997 Anderson
5,736,928 A 4/1998 Tice et al.
5,764,142 A 6/1998 Anderson et al.
5,798,701 A 8/1998 Bernal et al.

(Continued)

OTHER PUBLICATIONS

Muller, H. C., et al., "New Approach to fire Detection Algorithms Based on the Hidden Markov Model," International Conference on Automatic Fire Detection "AUBE '01", 12th Proceedings, National Institute of Standards and Technology, Mar. 25-28, 2001, pp. 129-138.

(Continued)

*Primary Examiner* — Steven Lim
*Assistant Examiner* — Omeed Alizada
(74) *Attorney, Agent, or Firm* — Cahn & Samuels, LLP

(57) ABSTRACT

A microprocessor controlled hazardous condition detection system with volatile and non-volatile memory containing a sensor package and an alarm element associated with the sensor package through a microprocessor, wherein a clean air value is loaded into the volatile memory; where the microprocessor receives periodic readings of predetermined environmental conditions from the sensor package, stores the periodic readings in the volatile memory, calculates an average of a plurality of said periodic readings and generates a new clean air value by shifting the clear air value loaded into said volatile memory by a differential between the calculated average environmental reading and the established clean air value and generates an alarm if the difference exceeds an established threshold.

19 Claims, 16 Drawing Sheets

(56) References Cited

U.S. PATENT DOCUMENTS

| | | | |
|---|---|---|---|
| 5,831,524 | A | 11/1998 | Tice et al. |
| 6,107,925 | A | 8/2000 | Wong |
| 6,150,935 | A | 11/2000 | Anderson |
| 6,166,647 | A | 12/2000 | Wong |
| 6,166,648 | A | 12/2000 | Wiemeyer et al. |
| 6,222,456 | B1 | 4/2001 | Tice |
| 6,320,501 | B1 | 11/2001 | Tice et al. |
| 6,861,951 | B2 | 3/2005 | Reghetti et al. |
| 6,975,223 | B1 | 12/2005 | Mladen et al. |
| 7,076,403 | B2 | 7/2006 | Tice |
| 7,142,105 | B2 | 11/2006 | Chen |
| 7,154,402 | B2 | 12/2006 | Dayoub |
| 7,161,481 | B2 | 1/2007 | Turner |
| 7,170,418 | B2 | 1/2007 | Rose-Pehrsson et al. |
| 7,218,708 | B2 | 5/2007 | Berezowski et al. |
| 7,221,260 | B2 | 5/2007 | Berezowski et al. |
| 7,227,450 | B2 | 6/2007 | Garvy et al. |
| 7,242,292 | B2 | 7/2007 | Berezowski et al. |
| 7,280,039 | B2 | 10/2007 | Ito et al. |
| 7,307,539 | B2 | 12/2007 | Harvey et al. |
| 7,327,247 | B2 | 2/2008 | Tice |
| 7,649,450 | B2 | 1/2010 | Campion, Jr. et al. |
| 2002/0118116 | A1 | 8/2002 | Tice et al. |
| 2003/0004426 | A1 | 1/2003 | Melker et al. |
| 2003/0020617 | A1 | 1/2003 | Tice et al. |
| 2006/0192670 | A1 | 8/2006 | Tice |
| 2006/0212570 | A1 | 9/2006 | Aritsuka et al. |
| 2007/0110221 | A1 | 5/2007 | Berezowski et al. |
| 2007/0152809 | A1 | 7/2007 | Berezowski et al. |
| 2007/0188337 | A1 | 8/2007 | Mi et al. |
| 2008/0068267 | A1 | 3/2008 | Huseth et al. |
| 2008/0122696 | A1 | 5/2008 | Huseth et al. |
| 2008/0180258 | A1 | 7/2008 | Lang et al. |

OTHER PUBLICATIONS

Bahrepour, M., et al, "Automatic Fire Detection: A Survey From Wireless Sensor Network Perspective," Pervasive Systems Group, University of Twente.

Bahrepour, M., et al., "Use of AI Techniques for Residential Fire Detection in Wireless Sensor Networks," AIAI-2009 Workshops Proceedings, Pervasive Systems Research Group, Twente University, the Netherlands, pp. 311-321.

Gottuk, D., et al., "Advaned Fire Detection Using Multi-signature Alarm Algorithms," Hughes Associates, Inc., Baltimore, MD, pp. 140-149.

Huckaby, E., et al., "Computational fluid dynamics modeling of the operation of a flame ionization sensor," 5th US combustion Meeting, Organized by the Western States Section of the Combustion Institute and Hosted by the University of California at San Diego, Mar. 2007.

Jones, W., "A Review and Implementation of Algorithms for Fast and Reliable Fire Detection," National Institute of Standards and Technology, Technology Administration, U.S. Department of Commerce, NISTIR 7060.

Roby, R, et al., "A Smoke Detector Algorithm for Large Eddy Simulation Modeling," NIST GCR 07-911, National Institute of Standards and Technology, Technology Administration, U.S. Department of Commerce.

Lazarus, Ron et al., "USI Proposal and Quotation, a Presentation to the Home Depot," May 27, 2009, USI Electric, Chicago, IL., USA.

Haigh, Phil et al., "USI Product Presentation, Home Safety Products-Alarms at the National Hardware Show," May 6, 2009, USI Electric, Chicago, IL., USA.

* cited by examiner

803

DYNAMIC ALARM SENSITIVITY ADJUSTMENT AND AUTO-CALIBRATING SMOKE DETECTION

This application claims the benefit of U.S. patent application Ser. No. 12/572,707 filed on 2 Oct. 2009 in the U.S. Patent and Trademark Office which claims the benefit of U.S. Provisional Application Ser. No. 61/102,478 filed on 2 Oct. 2008.

I. FIELD OF THE INVENTION

This invention relates to the field of hazardous condition detectors in general and specifically to a hazardous condition detector with ambient condition compensation.

II. BACKGROUND OF THE INVENTION

Fire detection devices such as smoke detectors and/or gas detectors are generally employed in structures or machines to monitor the environmental conditions within the living area or occupied compartments of a machine. These devices typically provide an audible or visual warning upon detection of a change in environmental conditions that are generally accepted as a precursor to a fire event.

Typically, smoke detectors include a smoke sensing chamber, exposed to the area of interest. The smoke detector's smoke sensing chamber is coupled to an ASIC or a microprocessor circuit. The smoke sensor samples the qualities of the exposed atmosphere and when a change in the atmosphere of the exposed chamber is detected by the microprocessor, an alarm is sounded.

There are two types of smoke sensors that are in common use: optical or photoelectric type smoke sensors and ionization type smoke sensors. Photoelectric-based detectors are based on sensing light intensity that is scattered from smoke particles. Light from a source (e.g. LED) is scattered and sensed by a photosensor. When the sensor detects a certain level of light intensity, an alarm is triggered.

Ionization-type smoke detectors are typically based on a radioactive material that ionizes some of the molecules in the surrounding gas environment. The current of the ions is measured. If smoke is present, then smoke particles neutralize the ions and the ion current is decreased, triggering an alarm.

The ionization smoke detectors that are currently available in the market are very sensitive to fast flaming fires. This type of fire produces considerable energy and ionized particles, which are easily detected by the sensor.

Although the ionization technology is very inexpensive compared with other technologies and has been installed in millions of homes, there is discussion regarding phasing out of this product category. It has been suggested by some members of the National Fire Protection Agency (NFPA) that ionization smoke sensors do not readily detect smoldering fires.

Smoldering fires most commonly result from cigarette ignition of materials found in homes such as sofas and beds. A smoldering fire typically produces cold smoke particles of which only a small portion is ionized. Because ionization technology focuses on detection of ionized particles, smoldering fire detection may be inconsistent.

Traditional methods of achieving consistent detection of fast flaming fires, with adequate detection of smoldering fires with ionization type smoke sensors, require the use of ionization type sensors coupled with optical or photoelectric type smoke sensors and/or gas sensors. Such a system is disclosed in U.S. Pat. No. 7,327,247 in which outputs from a plurality of different types of ambient condition sensors are cross-correlated so as to adjust a threshold value for a different, primary, sensor. The cross-correlation processing can be carried out locally in a detector or remotely. To minimize false alarming, the alarm determination may be skipped if the output from the primary sensor does not exhibit at least a predetermined variation from an average value thereof. These combination type systems are complex and therefore rather expensive, but heretofore are typical of the current solutions for consistent detection of flaming and smoldering fires.

Other approaches to achieve adequate detection of fires with low false alarm rates incorporate various filtering methods, which are typically used to prevent false or nuisance alarms. These conventional methods typically are inefficient in that they either unnecessarily delay the detection of a fire event, or they require unnecessarily processing of the signal, which delays fire event detection and significantly increases the system's power consumption. Such a system is disclosed in U.S. Pat. No. 5,736,928, which is directed to an apparatus and a method to pre-process an output signal from an ambient condition sensor. The preprocessing removes noise pulses which are not correlated with an ambient condition being sensed. The preprocessing is carried out by comparing the present output value to a prior output value and selecting a minimum value there between. The apparatus and methods incorporate storage for two prior values and the present output value is compared to the two prior values. A minimum or a maximum of the three values is selected. Additional processing is typically carried out by comparing the present output value to a nominal expected clear air output value, and if the present value exceeds the nominal expected output value, a minimum is selected among the present output value and one or more prior values. If the present output value is less than the nominally expected value, a maximum is selected from among the present output value and one or more prior output values. This approach is inefficient in that the filtering method used unnecessarily removes relevant signal information and delays the system response to a fire event.

Other systems employ multiple filtering operations. One such system is disclosed in U.S. Pat. No. 5,612,674, which describes a noise immune detection system having a plurality of detectors that generate respective indicia representative of adjacent ambient conditions. A communications link extends between the detectors. A control element is coupled to the link to receive and process the indicia and to adjust an alarm threshold level in response to noise levels in the system. Respective indicia are filtered twice by the control element. In the presence of noise, as reflected in relative values of the filtered values of the indicia, the threshold value is automatically increased. This approach tends to be inefficient and unnecessarily expends processing resources. The disclosed patent requires computational intensive multiple filtering iterations applied to a previously filtered signal.

A variety of optical gas sensors for detecting the presence of hazardous gases, especially carbon monoxide ("CO"), are also known.

Typically, optical gas sensors include a self-regenerating, chemical sensor reagent impregnated into or coated onto a semi-transparent substrate. The substrate is typically a porous monolithic material, such as silicon dioxide, aluminum oxide, aluminosilicates, etc. Upon exposure to a predetermined target gas, the optical characteristics of the sensor change, either darkening or lightening depending on the chemistry of the sensor.

Smoke and gas sensors can be affected by temperature, humidity, and dust particles. One or a combination of these ambient factors can cause a smoke or gas detector to false alarm.

Traditional methods of compensating for ambient environmental factors typically include adjusting the output of the sensors. Such an approach is disclosed in U.S. Pat. No. 5,798,701, which is directed to a self-adjusting, self-diagnostic smoke detector. The detector includes a microprocessor-based alarm control circuit that periodically checks the sensitivity of a smoke sensing element to a smoke level in a spatial region. The alarm control circuit and the smoke sensor are mounted in a discrete housing that operatively couples the smoke sensor to the region. The microprocessor implements a routine stored in memory by periodically determining a floating adjustment that is used to adjust the output of the smoke sensing element and of any sensor electronics to produce an adjusted output for comparison with an alarm threshold. The floating adjustment is not greater than a maximum value or less than a minimum value. Except at power-up or reset, each floating adjustment is within a predetermined slew limit of the immediately preceding floating adjustment. The floating adjustment is updated with the use of averages of selected signal samples taken during data gathering time intervals having a data gathering duration that is long in comparison to the smoldering time of a slow fire. The adjusted output is used for self-diagnosis.

These self adjusting systems are not optimized for the detection of traditional fires as well as smoldering fire events with a single sensor, nor do they employ multiple fire event specific thresholds from which the processor may select.

III. SUMMARY OF THE INVENTION

Disclosed is a microprocessor controlled hazardous condition detection system including a housing containing a sensor package; the sensor package contains sensors exposed to the ambient environment. The sensors take periodic readings of predetermined environmental conditions. The disclosed system also includes an alarm means coupled to the sensor package through a microprocessor having volatile and non-volatile memory.

The non-volatile memory features an alarm differential value stored therein and a designated clean air alarm threshold being stored in the non-volatile memory as well. Upon system power-up, the clean air alarm threshold is loaded into the volatile memory; and the microprocessor receives periodic readings of predetermined environmental conditions from the sensor package. The microprocessor preprocesses each received signal generating at least three conditioned signals for each received signal. The conditioned signals are generated by applying different levels of signal filtering to the received signals, generating a set of conditioned signals representative of the periodic reading received. Each conditioned signal in the set has a different signal to noise ratio optimized for a different signal processing task. Each set of conditioned signals is stored in the volatile memory. Based on comparisons made during the signal processing the microprocessor selects a stored alarm threshold from a plurality of stored alarm thresholds optimized to detect a certain fire profile. The microprocessor also adjusts the selected alarm threshold to compensate for changes in the ambient conditions over time by shifting the alarm threshold loaded into the non volatile memory by a small amount based on the calculated difference in the default clean air alarm threshold and the environmental readings accumulated over a period of several hours.

Also disclosed is a hazardous condition detector that is ionization-technology-based optimized to readily detect smoldering as well as traditional flash fires using a single ionization type sensor. This technology is an improvement over existing photoelectric detector technology by providing a sensor possessing enhanced detection capabilities for smoldering fires. Performance of the disclosed invention corresponds to a dual technology alarm system incorporating separate photo and ion sensors while using only the more economical ionization sensors.

The disclosed invention employs microprocessor control to analyze the character/type of smoke by tracking the rate of rise of the sensor signal over a predetermined time period. The disclosed invention pre-processes each sensor signal received, generating at least three conditioned signals representative of the received sensor signal. Each conditioned signal is optimized for a particular signal processing comparison, and is selected and employed by the microprocessor during signal processing to optimize the thresholds employed to define an alarm event. Smoldering fires yield a slow but persistent change in ionization signal and fast flaming fires will produce rapid measured signal change. Rate of rise will be different depending on the type of fire. The disclosed invention employs a plurality of distinct alarm thresholds for different types of fire events. By employing periodic sampling, and using a microprocessor to evaluate the rate of ionized particle change, and selecting a particular alarm threshold from the plurality of available thresholds based on the characteristics of the of ionized particle change, both types of fires are readily detected.

The present invention also features auto-calibration for dynamically establishing the alarm-threshold-reference based on a measurement of clear air. As such, the calibration technology of the present invention is based on the "smart" performance of a microcontroller. By relying on in situ calibration, the disclosed detector alarm units possess similar if not the same sensitivity level across different manufacturing batches and enable dynamically modified and accurate alarm sensitivity level adjustment. Alarm sensitivity may be increased when a smoldering fire is detected to allow the product to alarm faster even with small levels of detected signal. Also, the alarm sensitivity may be decreased when a fast flaming fire is detected to minimize nuisance alarms.

The present invention also discloses a smoke ASIC Wake Up feature wherein the smoke ASIC is used in conjunction with the microcontroller. The ASIC performs other necessary features of a smoke detector such as multi-station, communication, horn driving, low battery detection, signal latching, and/or buffering of the smoke sensor signal. The disclosed wake up feature minimizes power consumption by employing a microprocessor halt or active halt mode. The sensitivity pin of the ASIC is used as an external interrupt to wake up the microprocessor.

As used herein "substantially," "generally," and other words of degree are relative modifiers intended to indicate permissible variation from the characteristic so modified. It is not intended to be limited to the absolute value or characteristic which it modifies but rather possessing more of the physical or functional characteristic than its opposite, and preferably, approaching or approximating such a physical or functional characteristic.

IV. BRIEF DESCRIPTION OF THE DRAWINGS

In order to describe the manner in which the invention can be obtained, a more particular discussion of the invention briefly set forth above will be rendered by reference to specific embodiments thereof which are illustrated in the appended drawings. Understanding that these drawings depict only typical embodiments of the invention, and are not, therefore, to be considered to be limiting of its scope, the invention will be described and explained with additional specificity and detail through the use of the accompanying drawings.

V. DETAILED DESCRIPTION OF THE INVENTION

Various embodiments are discussed in detail below. While specific implementations of the disclosed technology are discussed, it should be understood that this is done for illustration purposes only. A person skilled in the relevant art will recognize that other components and configurations may be used without departing from the spirit and scope of the invention.

Figure 1:
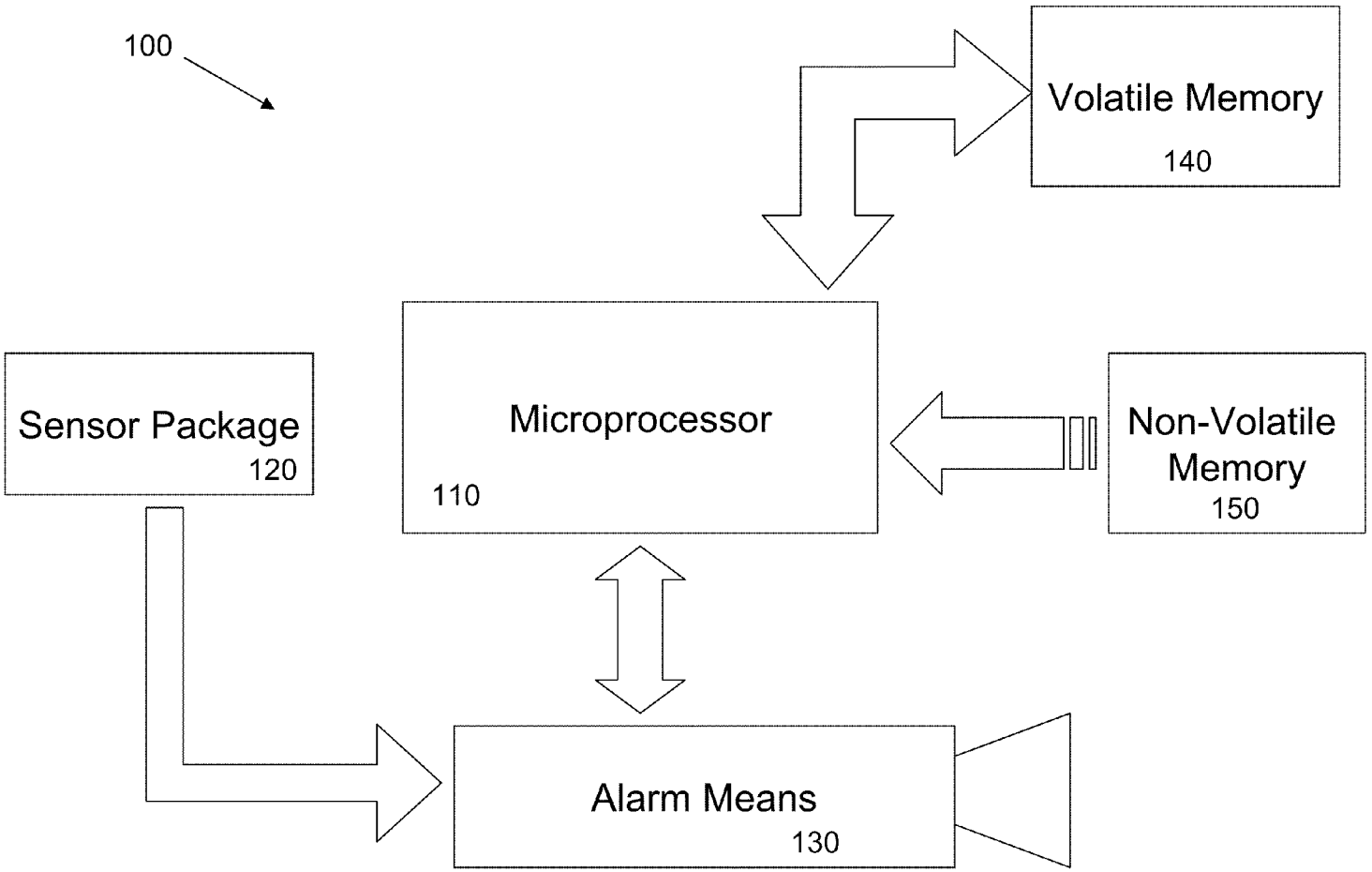
FIG. 1 is a block diagram of an exemplarily embodiment of a microprocessor controlled hazardous condition detection system employing the disclosed ambient condition compensation feature.

Referring now to the figures, wherein like reference numbers denote like elements, FIG. 1 illustrates an exemplarily embodiment of a microprocessor controlled hazardous condition detection system employing the disclosed ambient condition compensation feature. As shown in FIG. 1, the hazardous condition detection system 100 features a housing 101 containing a sensor package 120. The sensor package 120 contains at least one sensor that is exposed to the ambient environment and takes periodic readings of at least one predetermined environmental condition. The sensor package 120 may be comprised of a smoke sensor, a gas sensor, a heat sensor or other sensor, such as a motion sensor. In addition, the sensor package may feature a combination of sensors that provides periodic reading of a plurality of environmental conditions.

Figure 2:
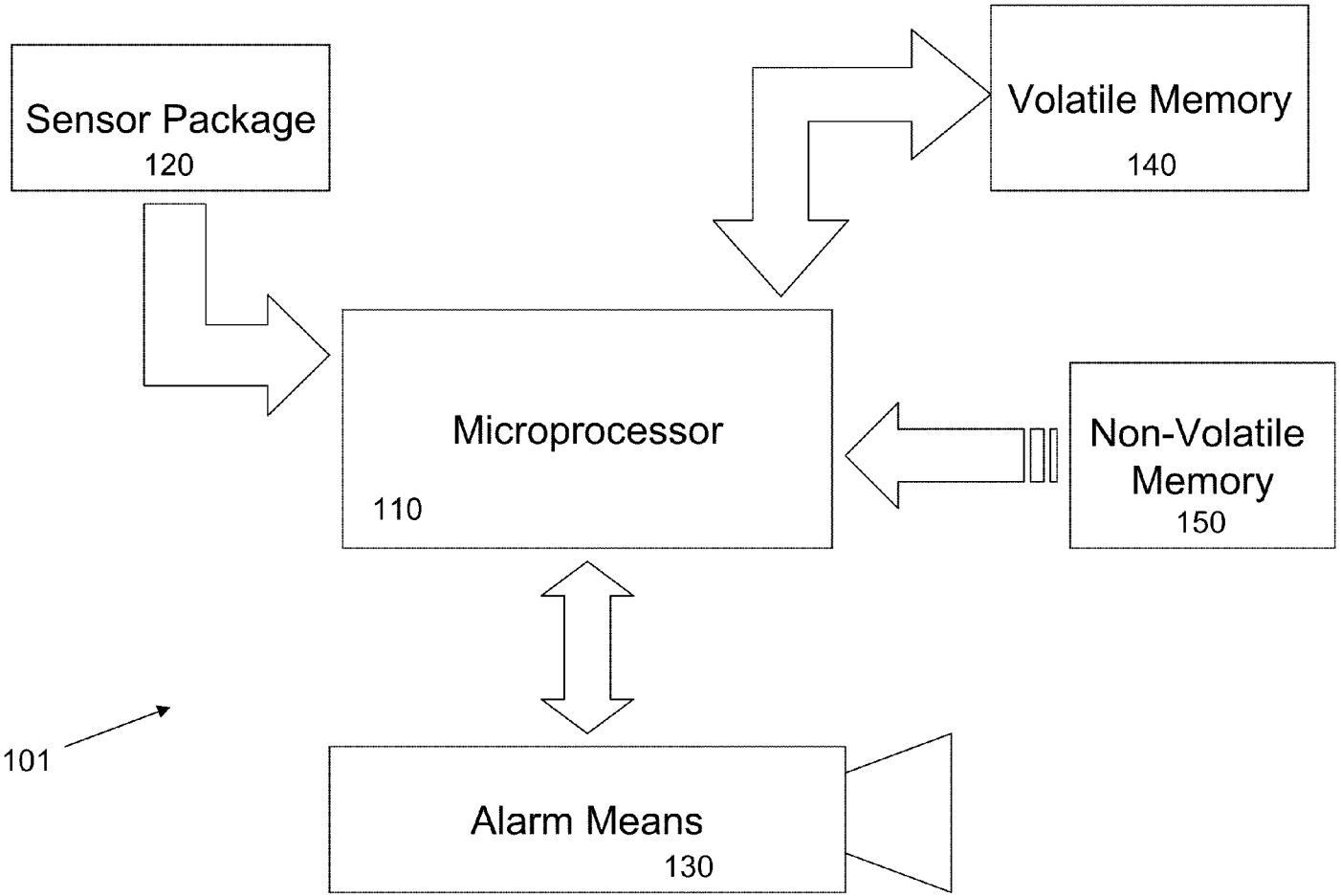
FIG. 2 is a block diagram of an embodiment of the system for hazardous condition detection wherein the sensor package is coupled directly to the microprocessor.

Sensor package 120 is coupled to at least one microprocessor 110 via an alarm means 130. Alarm means 130 is an ASIC optimized for hazardous condition detector use (smoke, gas, intrusion, etc.) and any supporting components including the visual, electronic, optical, magnetic and or audible signaling components. In other embodiments, the sensor package 120 may be coupled directly to the microprocessor 110 as illustrated in FIG. 2. Microprocessor 110 is coupled to or features volatile memory 140 and non-volatile memory 150. The volatile memory 140 and non volatile memory 150 may be resident on the microprocessor 110, or it may be embodied in a different or combination of chips.

In example embodiments, microprocessor 110 employs a comparison algorithm to determine the existence of a hazardous condition. A reading without smoke, dangerous levels of gas or other contaminants (clear air) is taken at the factory. This value is stored in non-volatile memory 150 which is typically in the form of an EEPROM or FLASH memory. The alarm level, or alarm threshold, is determined by the software by subtracting a predetermined alarm threshold differential from the default clear air reading. The hazardous condition detector generates an alarm when the signal of the sensor reaches or surpasses or otherwise violates the alarm threshold level. The determination of an alarm condition is governed by the following relation:

Default clean air−alarm threshold differential=X, where X is the alarm threshold, and is compared with the current environmental readings to determine the existence of an alarm condition.

Typically, if X is greater than or equal to the current environmental reading, or otherwise inconsistent with some alarm parameter, then the alarm condition is met and the system goes into alarm mode. In other embodiments, if X is less than or equal to the current environmental reading, the system goes into an alarm mode.

As denoted by the arrows in FIG. 1, microprocessor 110 receives information from the non-volatile memory 150 and retrieves and stores information from the volatile memory 140. The non-volatile memory 150 contains an alarm differential value and a clean air default value stored therein. The data in the non-volatile memory designating the alarm differential value and the clean air default value are typically set and calibrated at the factory; however, one or more of the default settings in the non-volatile memory may be set and calibrated at a later date. Microprocessor 110 selects a default alarm threshold by adding the differential value to the clean air default value, or subtracting the differential value therefrom.

This auto-calibration feature enables minimized alarm threshold variations between manufactured products, thereby providing for consistent alarm thresholds for a plurality of manufactured products. Also, the auto-calibration feature is useful in allowing the basic hazardous condition detector to compensate for changes in the environment that will keep the alarm conditions consistent through varying environmental conditions. This consistency also enables a manufacture or end user to dynamically vary the alarm threshold values to obtain consistent results for the different types of fires (Underwriter Laboratories—Paper, Wood, Flammable Liquid Fire Test). The ability to vary the alarm threshold values is a significant development in the field, and as employed in the instant invention breathes new life into the art of ionization sensing smoke detectors.

Specifically, this feature introduces the concept of ionization optimization, through which the performance of ionization type smoke detectors is enhanced by employing at least two distinct alarm thresholds for the ionization sensor. These include a traditional ionization alarm threshold optimized for traditional or fast flaming fires, and an enhanced alarm threshold specifically optimized for the detection of a smoldering fire event. Other alarm thresholds may be employed as well. The use of optimized alarm thresholds with the ionization sensing smoke sensor dispenses with the need for additional, multiple or supplemental sensors for consistent detection of different types of fires.

Figure 4:
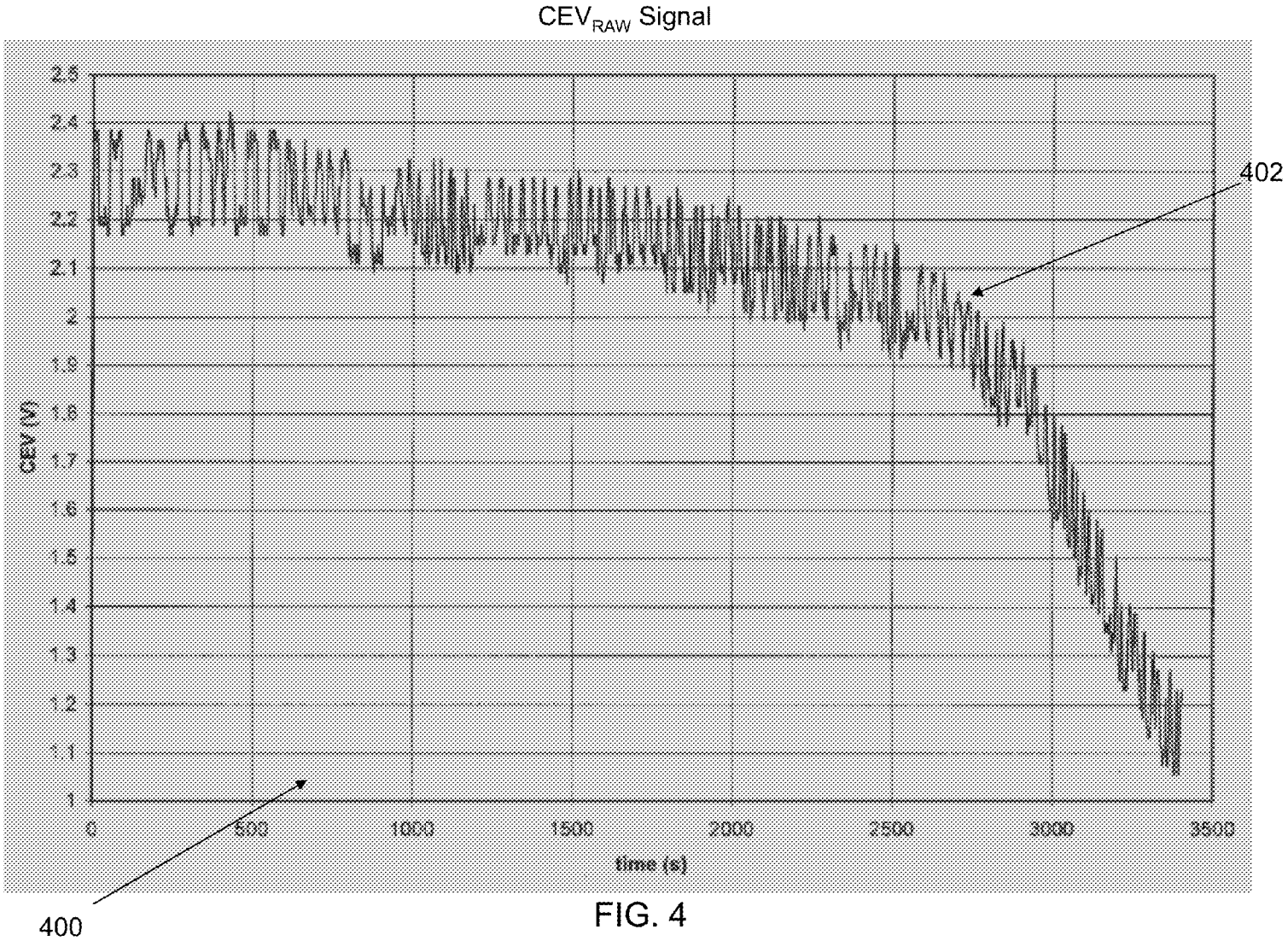
FIG. 4 is a graph of an exemplarily unconditioned output sample of an ionization sensor during a smoldering fire event ($CEV_{RAW}$).

As discussed in the background section, smoke detectors typically operate by detecting a change in the environment, either in the form of light intensity or population of ionized particles sampled through a smoke chamber. In this manner an ionization type smoke sensor detects a decrease in the current flow, and ultimately voltage measured across the ion sensor electrodes disposed within the smoke detector's smoke chamber. As the smoke increases, the ionization levels in the ambient environment rise and this central electron voltage, or CEV, decreases. The resulting CEV readings are used to infer the ionization levels and ultimately the smoke present in the ambient environment. However, the sensor output voltage of ionization sensors is inherently noisy and attenuated in comparison to the sensor output of a photoelectric type smoke sensor. FIG. 4 shows a graph of an exemplarily unconditioned output sample of an ionization sensor during a smoldering fire event ($CEV_{RAW}$). Referring now to FIG. 4, the output signal 402 contains significant noise and attenuation. At some point in the graph the signal attenuates over 200 mV. This inherent noise and attenuation in the ionization sensor's signal, requires filtering of the signal to the level of being useful to evaluate. However, filtering of the signal to such a degree has traditionally slowed the ionization sensor's alarm response to the point of diminishing returns.

Another approach is to manipulate the alarm threshold values. However, insensitive ionization type units, tend not to respond to smoldering fires even if the sensitivity level is increased. Sensitive units in which the threshold differential value is lowered, raising the alarm threshold level to aid in the detection of smoldering fires may become overly sensitive, resulting in false (nuisance) alarms.

The instant invention seeks to overcome such limitations. Depending on the type of ambient conditions detected, the alarm threshold levels are optimized to provide consistent alerts for smoldering fires and fast flaming fires, while simultaneously retaining the robustness necessary to avoid nuisance alarms.

This optimization of the alarm thresholds is accomplished via the use of a microprocessor which preprocesses the output voltage of ionization sensor and generates a set of conditioned signals for each output signal received from the sensor package. During this pre-processing step, the microprocessor employs three different levels of signal filtering, generates and stores at least three conditioned or filtered signals V1, V2 and V3 for each sensor output voltage received from the sensor package. Each level of filtering generates a conditioned signal having an optimized combination of signal to noise and ultimately signal response. During signal processing, the microprocessor selects and employs each conditioned signal at predetermined points in the ionization optimization algorithm to make optimized comparisons that are uniquely suited to the signal to noise ratio of the selected conditioned signal. This allows the microprocessor to efficiently select and or adjust the applied alarm threshold for ionization optimization.

Figure 3:
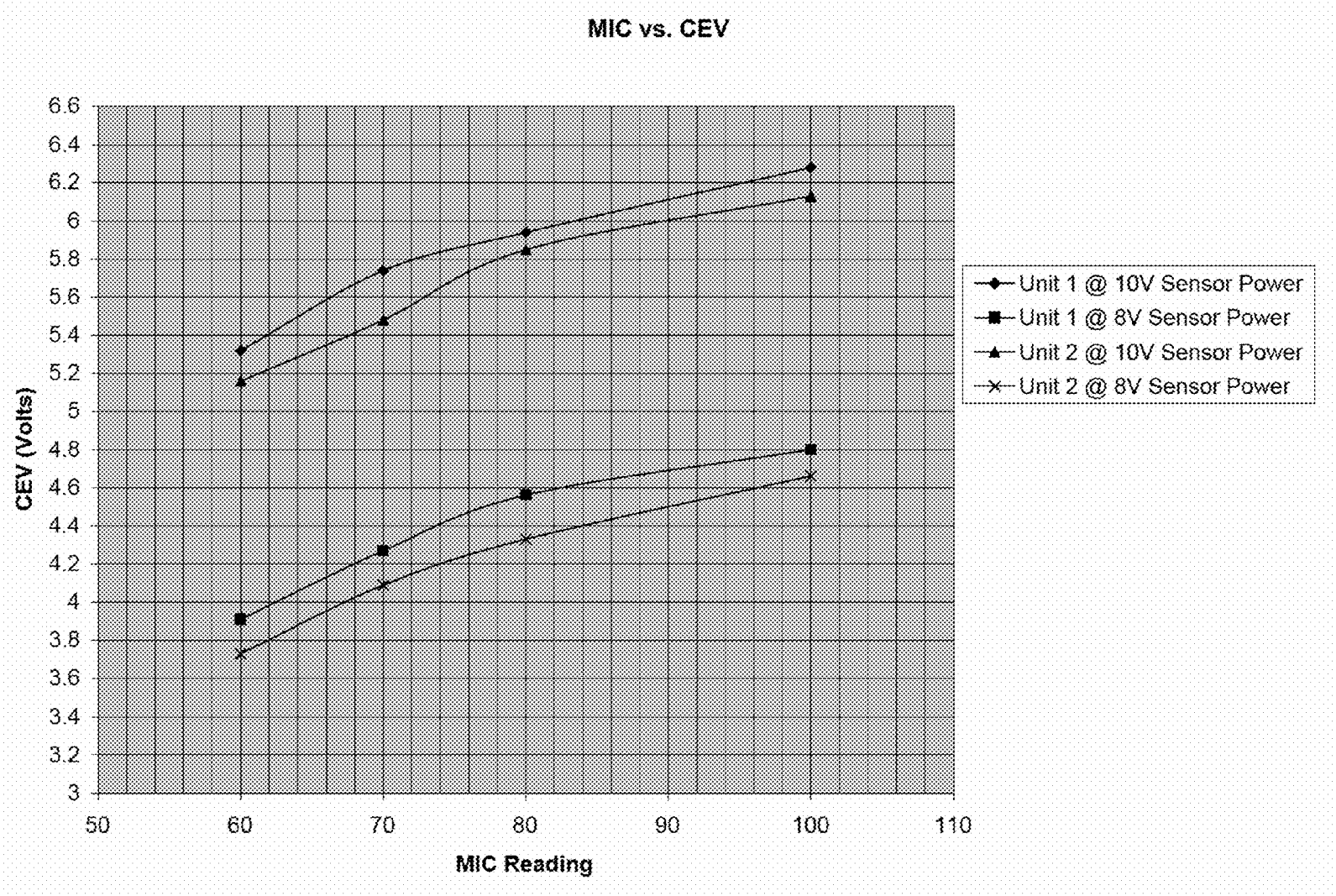
FIG. 3 is a graph obtained using a UL smoke box and illustrates the CEV versus the amount of smoke (ionized particles) read by the smoke box.

FIG. 3 is obtained using a UL smoke box and is a graph of the CEV versus the amount of smoke (ionized particles) read by the smoke box. The ion sensor is exposed to a UL prescribed smoke build-up inside the smoke box. The output CEV of the product is measured and plotted against the smoke reading obtained by the smoke box (MIC Reading). The MIC reading is the Measuring Ionization Chamber reading and is a standardized measurement used to quantify smoke density by level of smoke obscuration in the ionization chamber. 100 MIC is clean air 0% obscuration by smoke, and 60 MIC is 40% obscuration by smoke. 60 MIC is considered to be well into a smoldering fire event. Two samples were used to generate this graph. The upper two curves are CEV outputs of the two samples when using a 10 volt supply. The lower two curves are plots of the output when 8V is used. 100 MIC reading at 100% is clear-air. Even when different power supply levels are used, the resulting decrease and rate of decrease in CEV level is the same for the two power supply levels. Going from 100 MIC down to 60 MIC results in a consistent decrease of about 1V in CEV for both voltage supply levels.

Similarly, a gradual and consistent decrease in the CEV is a characteristic from the profile of a smoldering fire event that is efficiently detected by the ionization sensor of the inventive system and methods, without the use of additional sensors or detectors. By using the inventive system and methods, a hazardous condition detector employing a sensor package containing only an ionization sensor, coupled to a microprocessor for signal processing, can be optimized to detect both smoldering fires and fast flaming fires, thereby eliminating the need for photoelectric, gas or other supporting sensors. Coupled with microprocessor controlled ionization optimization, a smoke detector employing a single ionization type sensor may have two or more distinct and independent alarm profiles. One alarm profile may be optimized for traditional fire events, and a second alarm threshold is optimized to alert in the presence of a smoldering fire event. Each alarm profile has an independent and distinct alarm threshold associated with it. Other alarm thresholds may be specified for optimized detection of intermediate fire events. These distinctive sensitivity levels can automatically be employed by the microprocessor, based on sets of previous ionization readings.

A very consistent alarm level can now be computed for any microprocessor controlled ionization type product powered by any voltage level. The resulting equation is:

$$\text{Alarm Level} = CEV_{clear\text{-}air} - \text{Constant}_{alarm\ threshold},$$

where $CEV_{clear\text{-}air}$ is given by the previous formula above and 'Constant' is a voltage to alarm which typically corresponds to one or more predetermined MIC readings. The Alarm Level is also referred to as the $CEV_{ALARM}$ and the 'Constant' is also referred to as the alarm differential threshold or the $CEV_{DELTA}$. These formulas are used by the microprocessor to compute the default alarm level. The default alarm level is dynamically varied depending on one or more of the environmental conditions, the profile or characteristics common to a particular type of fire event (for example the rate of CEV change per time).

The $CEV_{ALARM}$ may also be considered to be the minimum acceptable CEV voltage for a non-alarm condition or $CEV_{MIN}$. If at any time the CEV voltage reading falls below this $CEV_{ALARM}$, an alarm condition is inferred by the signal processing microprocessor and the ASIC is signaled to go into alarm mode.

Referring again to FIG. 1, when the system 100 is initially powered up, the default air alarm threshold is loaded into the volatile memory 140. The microprocessor 110 receives periodic readings of predetermined environmental, or ambient, conditions from the sensor package 120, and stores the periodic readings of the environmental conditions in the volatile memory 140. The microprocessor 110 preprocesses each of these environmental readings by generating a set of at least three conditioned signals representative of the environmental reading. Each representative signal in the set results from a different level of filtering of the signal received from the sensor package, and has a signal to noise ratio optimized for a particular comparison that the microprocessor must make during signal processing. In other embodiments of the preprocessing step the microprocessor may generate more than three conditioned signals. When performing comparison the microprocessor selects and employs from the set of conditioned signals a conditioned signal having the appropriate signal to noise ratio to enhance signal discrimination and minimize false alarms.

Based on the results of these optimized comparisons, the microprocessor adjusts a selected alarm threshold by a small amount over time to compensate for changes in the ambient environment. When the system detects an ambient environmental condition outside of the alarm threshold stored in the volatile memory 140, the microprocessor 110 designates an alarm event and causes the alarm means 130 to generate an alarm.

This process of adjusting or varying the alarm threshold value within the given allowable range or selecting a new threshold optimized for the profile of the smoke detected enables the system 100 to dynamically adjust the sensitivity of the detector depending on the changes in the ambient environmental conditions in the monitored space such as heat, humidity, light, etc. In addition, in other embodiments, the alarm thresholds may be selected or altered based on predetermined variations in the type of smoke, or based on one or more particular characteristics of the smoke detected. This feature is especially useful in ionization based detectors. Typically, fast flaming fire will have a higher alarm threshold (embodied in a lower $CEV_{ALARM}$) and a smoldering fire will have a lower alarm threshold (embodied in a higher $CEV_{ALARM}$). All alarm levels are typically based on the rate of decrease of CEV reading with respect to time.

By varying the alarm thresholds via a microprocessor, based on the ambient condition variations over time, smoldering fires can now be efficiently detected with ionization type detectors acting independently without the aid of other types of sensors. Since these types of fire events typically yield a slow but persistent decrease in CEV signal while fast flaming fire events produce rapid measured signal decrease. The alarm sensitivity level may be increased when a profile suggesting the existence of a smoldering fire is detected to allow the product to alarm faster even with small levels of detected signal.

The microprocessor processes the CEV signals by employing a ionization optimization algorithm, which selects between a plurality of $CEV_{DELTA}$ values selected to increase or decrease the sensitivity of the ionization sensor package based on the characteristics of the smoke or smoke event detected. With each selected $CEV_{DELTA}$ value, the microprocessor generates a distinct $CEV_{ALARM}$ value, or alarm level.

Signal Conditioning and Ionization Optimization

The microprocessor, when powered up, stores the previous $CEV_{NEW}$ value into volatile memory 140 as the $CEV_{PREV}$ and receives a $CEV_{RAW}$ value from the ASIC. The $CEV_{RAW}$ value is the unprocessed and unconditioned CEV reading taken from the sensor package. The microprocessor then pre-processes the CEV reading taken from the sensor package generating a current $CEV_{NEW}$ by applying a signal conditioning algorithm to a $CEV_{RAW}$ value that is retrieved from the ionization sensor package coupled to the ASIC.

The signal conditioning algorithm removes the noise and attenuation from the $CEV_{RAW}$ signal received from the ASIC employing low frequency digital filtering in a narrow band to generate the $CEV_{NEW}$. The noise and attenuation is removed from the signal by conditioning the unprocessed CEV according to the following relation:

$$CEV_{NEW}=[CEV_{PREV}(N)+CEV_{RAW}(1)]/[N+1] \text{ where } N>>1.$$

The processor generates a $CEV_{NEW}$ by multiplying the previous stored CEV reading by a constant (N). This value is combined with the appropriate current $CEV_{RAW}$ and the sum is divided by the constant plus 1. The level of signal conditioning and the levels of noise and attenuation removal may be increased or decreased by changing the magnitude of this constant. As the size of the selected constant is increased, the greater the attenuation and noise removed from the signal. However, as the size of the constant is increased, time period is required to develop a meaningful trend of changing signals increases and the system response suffers. The various $CEV_{NEW}$ comparisons performed by the microprocessor during signal processing each require signals having different combinations of response versus attenuation for optimal performance.

The instant invention address this problem by generating a plurality of distinct $CEV_{NEW}$ values for each $CEV_{RAW}$ reading, by varying the constant (N) based on the microprocessor's signal processing requirements. Due to the varying signal requirements (response versus attenuation) the microprocessor employs at least three different N values having different magnitudes, generates and stores at least 3 distinct $CEV_{NEW}$ values for each $CEV_{RAW}$ reading received from the sensor package. In the presently described embodiment, the N value employed by the microprocessor for general ambient condition compensation approaches $2^{14}$ to enhance filtering. For smoke threshold selection settings, the N value employed approaches $2^7$. For smoke detection settings the N value employed approaches $2^2$.

Figure 7:
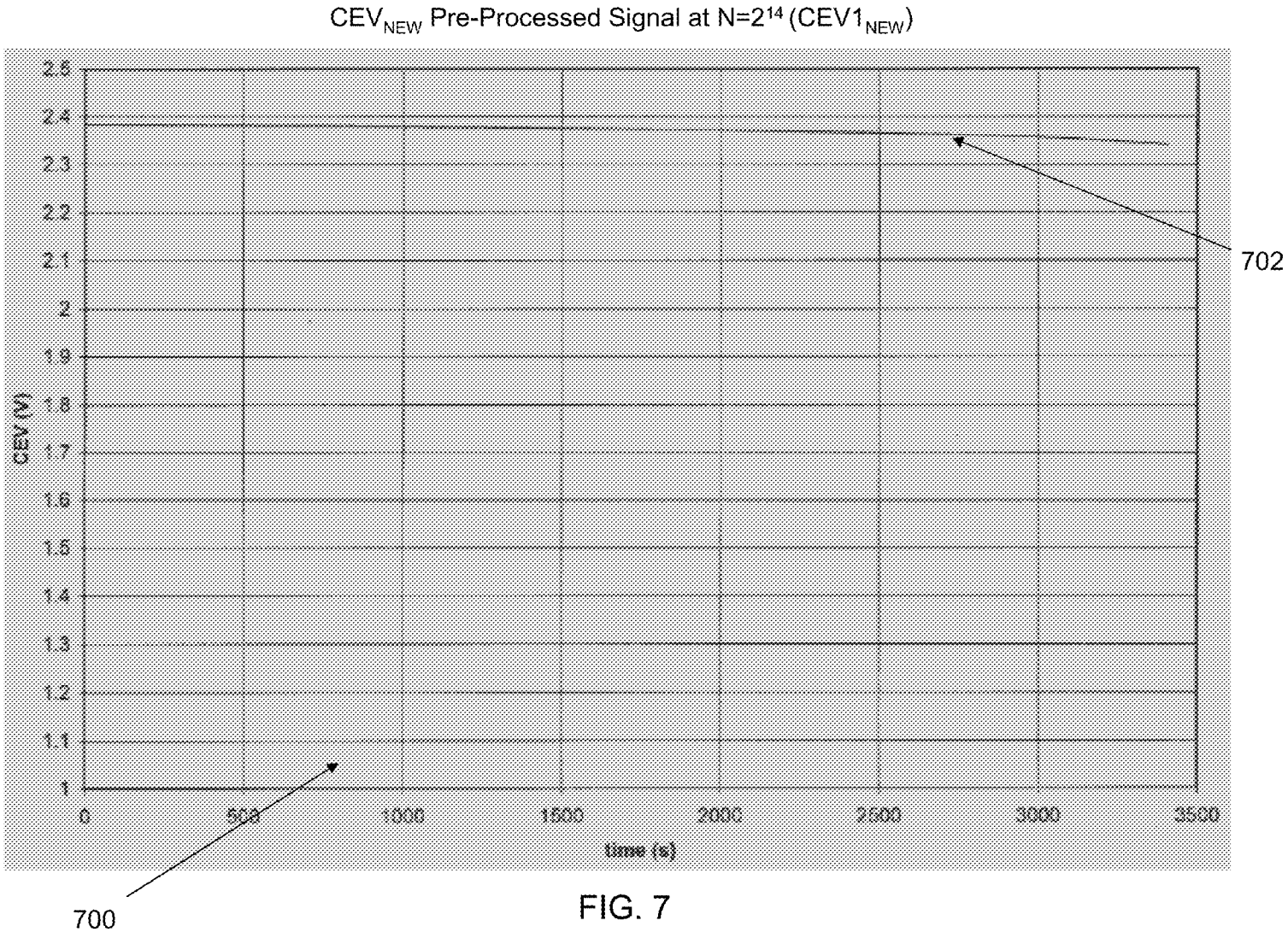
FIG. 7 is a graph of the exemplarily output sample of the ionization sensor of FIG. 4 pre-processed with a filtering constant of $2^{14}$ to generate $CEV1_{NEW}$.

A $CEV1_{NEW}$ value is generated by employing a N value approaching $2^{14}$. FIG. 7 is a graph of the output of the ionization sensor of FIG. 4, pre-processed with a filtering constant of $2^{14}$ 700 to generate $CEV1_{NEW}$ 702. The $CEV1_{NEW}$ value 702 is selected and used by the microprocessor for ambient condition compensation. The signal conditioning employed to generate the $CEV1_{NEW}$ value 702 is optimized to respond to slow gradual changes in the signal over a matter of hours. Since the response to this type of filtered signal is relatively slow it would return less than optimal results if employed to try to detect a traditional fast flaming fire.

Figure 6:
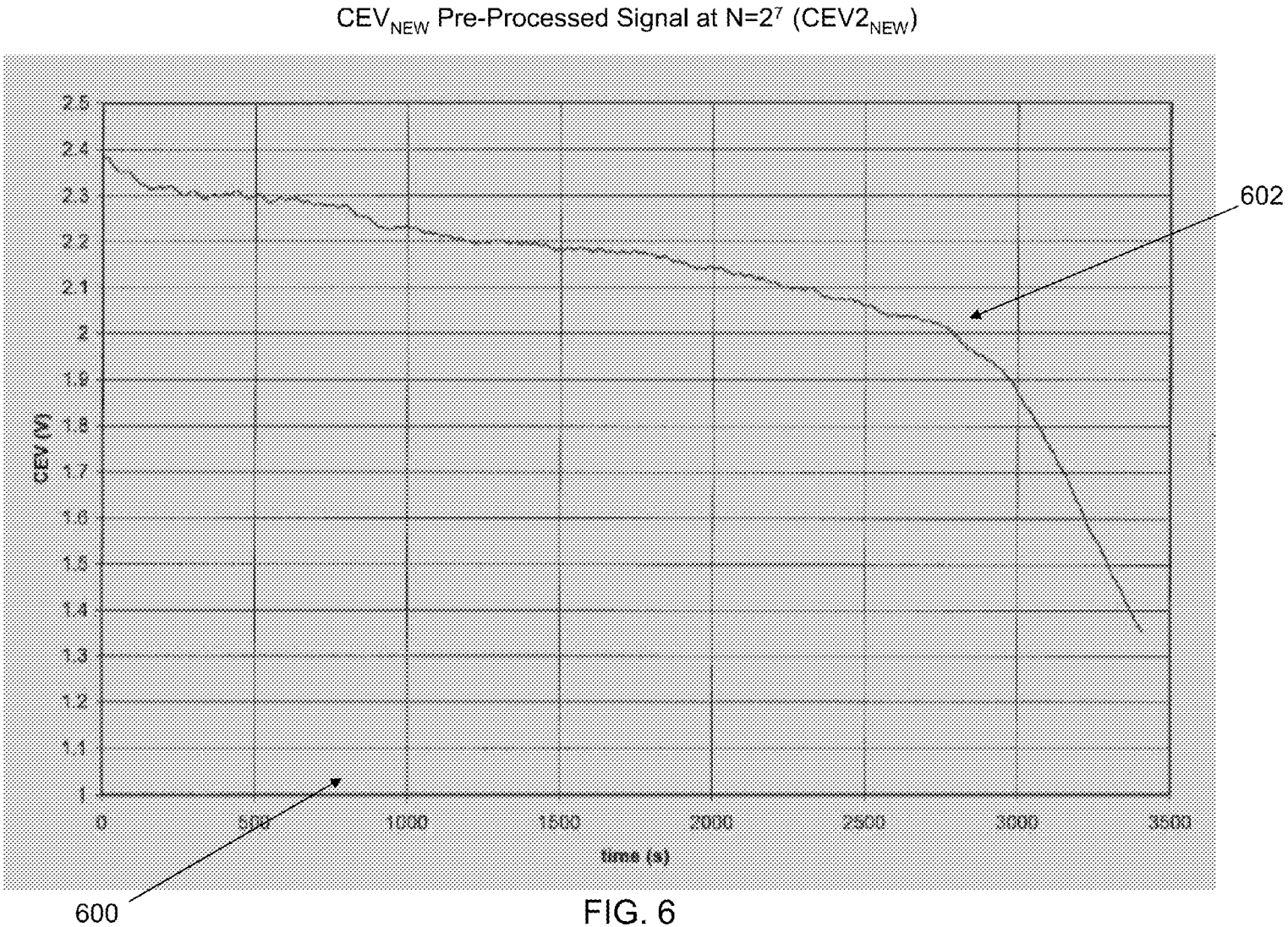
FIG. 6 is a graph of the exemplarily output sample of the ionization sensor of FIG. 4 pre-processed with a filtering constant of $2^7$ to generate $CEV2_{NEW}$.

A second $CEV_{NEW}$ value, $CEV2_{NEW}$ is generated by employing a N value approaching $2^7$. FIG. 6 is a graph of the output signal of the ionization sensor of FIG. 4, pre-processed with a filtering constant of $2^7$ 600 to generate $CEV2_{NEW}$ 602. The $CEV2_{NEW}$ value 602 is selected and used by the microprocessor to evaluate the rate of rise of the $CEV_{NEW}$ for purposes of selecting from the plurality of available threshold values for ionization optimization.

Figure 5:
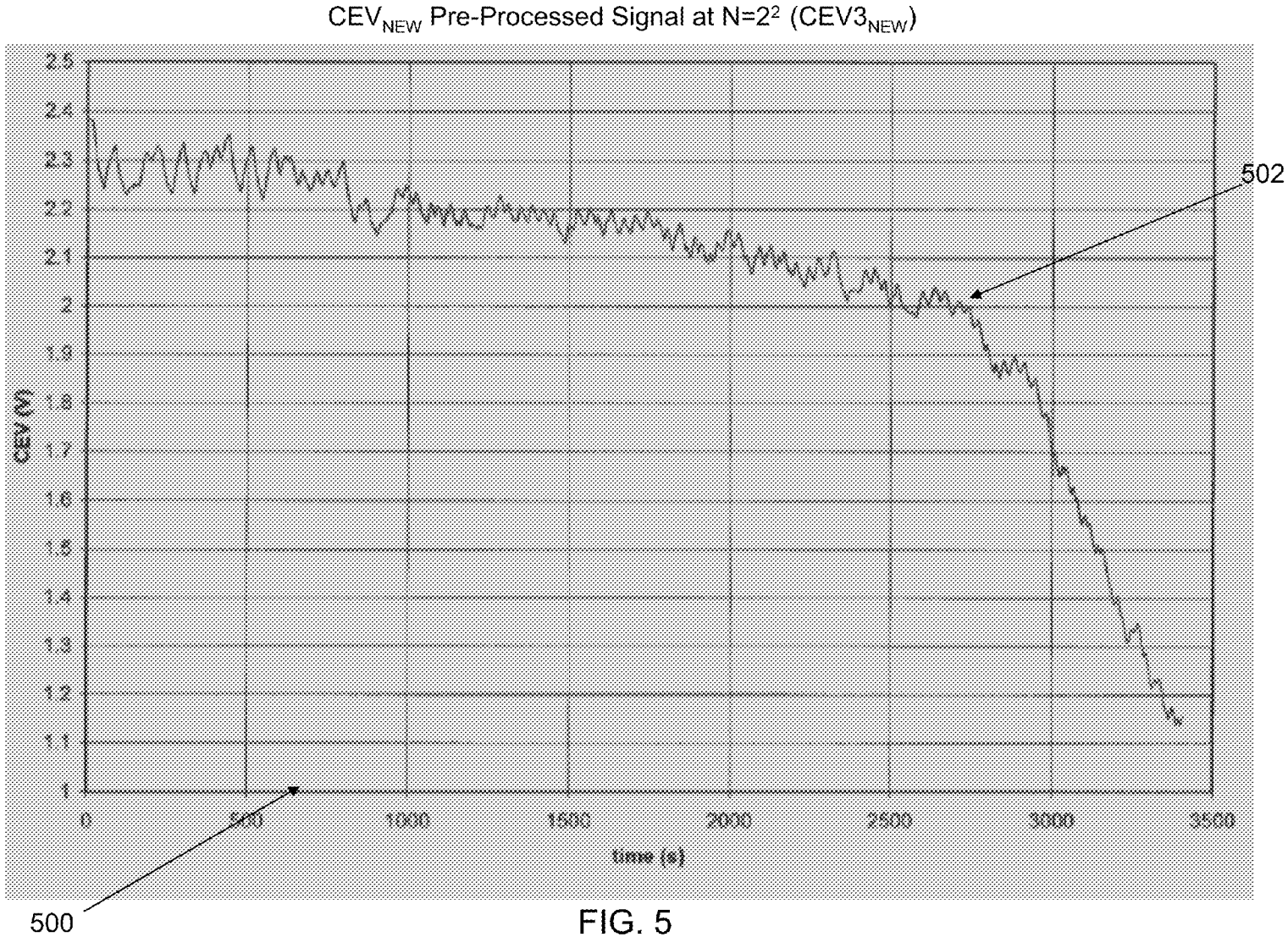
FIG. 5 is a graph of the exemplarily output sample of the ionization sensor of FIG. 4 pre-processed with a filtering constant of $2^2$ to generate $CEV3_{NEW}$.

A third $CEV_{NEW}$ value, $CEV3_{NEW}$ is generated by employing a N value approaching $2^2$. FIG. 5 is a graph of the output signal f the ionization sensor of FIG. 4 pre-processed with a filtering constant of $2^2$ 500 to generate $CEV3_{NEW}$ 502.

The $CEV3_{NEW}$ value 502 is selected and used by the microprocessor for the CEV comparison step to determine if an alarm condition is present. Employing the smaller $2^2$ constant generates a $CEV_{NEW}$ signal with a faster response time, making it more sensitive to abrupt changes in the conditions monitored by the ionizations sensor package. This characteristic makes the $CEV3_{NEW}$ value 502 most appropriate for the comparisons with the selected alarm threshold to determine the existence of a fire event.

Each set of generated $CEV_{NEW}$ values is stored in the volatile memory and particular $CEV_{NEW}$ values from the set are selected by the microprocessor depending on the comparison the microprocessor is performing. Typically, to conserve memory resources, the microprocessor will only store a set of the most recent $CEV_{NEW}$ values generated from a couple of detection iterations. The storage of the $CEV_{NEW}$ readings in volatile memory enables the system to efficiently process the CEV data, select and employ an appropriate alarm threshold from the plurality of alarm thresholds available to the microprocessor.

Figure 13:
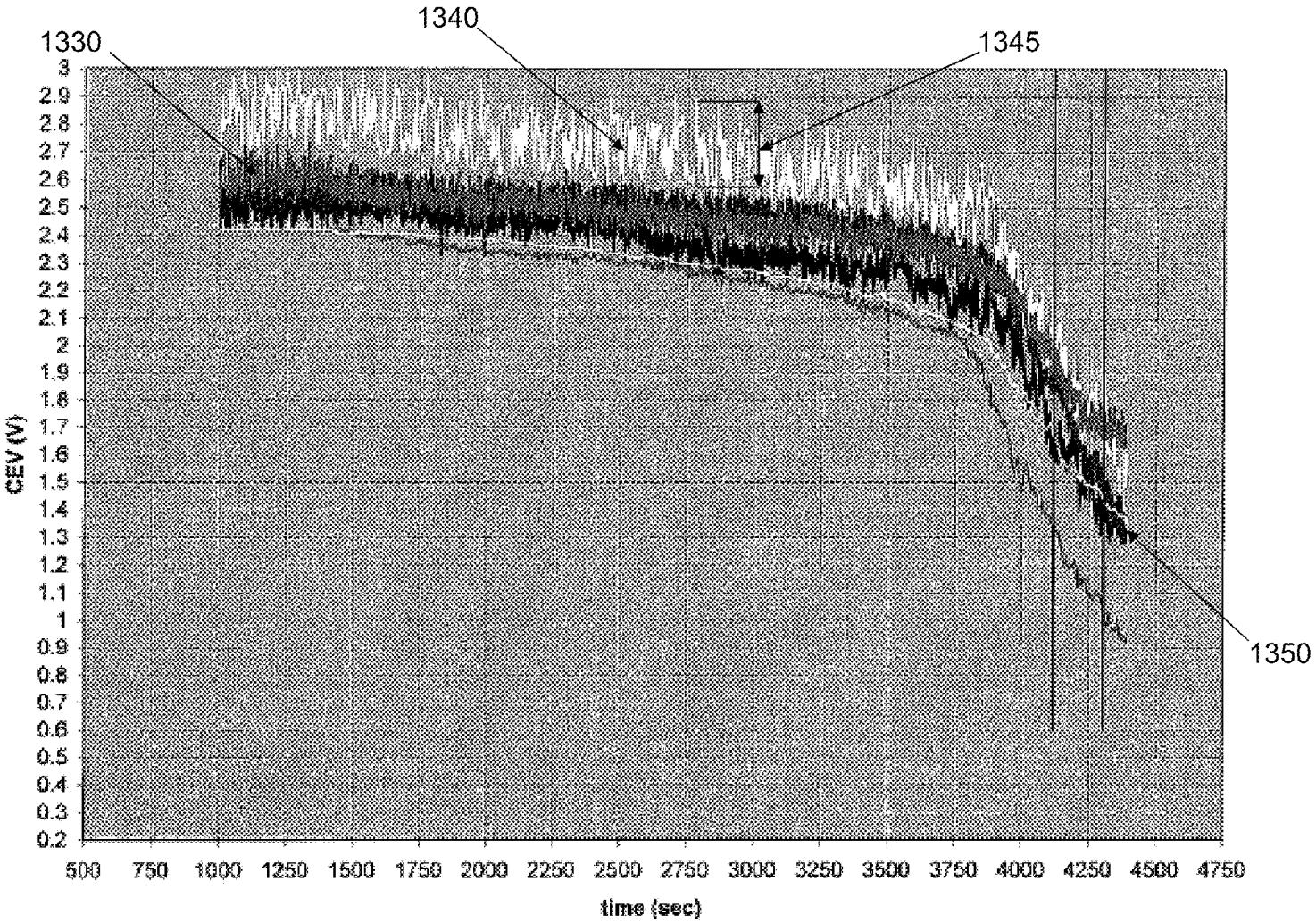
FIG. 13 is a graph illustrating the unconditioned output samples of the ionization sensor ($CEV_{RAW}$) as a function of time during a plurality of smoldering fire events.

FIG. 13 illustrates a graph of a plurality of unconditioned output samples of an ionization sensor ($CEV_{RAW}$) taken during a smoldering fire event. As shown on the graph, the plurality of $CEV_{RAW}$ signals 1330, 1340 and 1350 are significantly attenuated. For example, during the period from 2700 to 2750 seconds, the signal 1340 attenuates over 400 mV 1345. This attenuation severely limits the selection of consistent and useful thresholds since the large attenuation may be substantially greater than the optimal $CEV_{DELTA}$, preventing consistent and efficient evaluation of the CEV signal.

Figure 14:
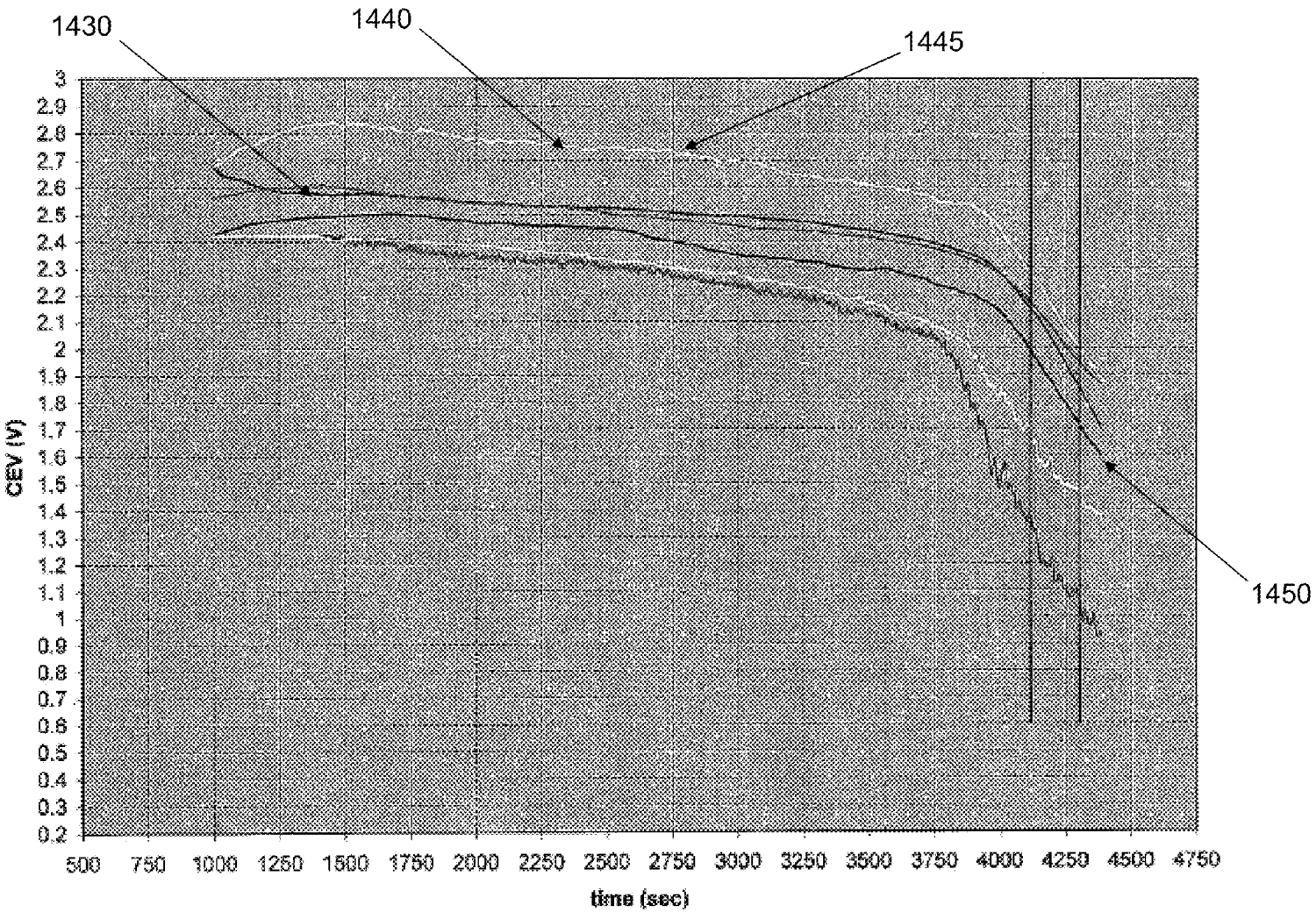
FIG. 14 is a graph illustrating the conditioned output samples of the ionization sensor ($CEV_{NEW}$) shown in FIG. 13 during the same smoldering fire events.

Referring now to FIG. 14 with continued reference to FIG. 13, FIG. 14 illustrates the same ionization sensor ($CEV_{RAW}$) samples shown in FIG. 13 after the noise and attenuation contained in the $CEV_{RAW}$ signals is removed. The microprocessor employs the signal conditioning algorithm in a pre-processing step generating the $CEV_{NEW}$ signal. In one from of the invention, the microprocessor employs a value for N approaching $2^7$ to remove the attenuation form the $CEV_{RAW}$ signal. As shown in the graph of FIG. 14, the $CEV_{NEW}$ signals 1430, 1440 and 1450, which correspond to 1330, 1340 and 1350, respectfully, feature greatly reduced levels of noise and attenuation. For example, during the period from 2700 to 2750 seconds, the signal 1440 attenuates less than 50 mV, compared to over 400 mV variance in $CEV_{RAW}$ 1345. The noise and attenuation levels being greatly reduced in 1445 the ability of the microprocessor 110 to make a meaningful characterization of the type of fire, and ultimately select the appropriate alarm threshold to apply is greatly enhanced.

In other embodiments, the sensor package may contain a microprocessor or the hazardous condition detector may employ multiple processors in the housing such that the pre-processing step is performed by one the other microprocessors.

The microprocessor compares $CEV_{NEW}$ with the $CEV_{ALARM}$ value. When the microprocessor determines that the $CEV_{NEW}<CEV_{ALARM}$ value, an alarm condition is inferred to be present and the microprocessor forces the ASIC into an alarm condition, generating an alarm. When the $CEV_{NEW}$ is determined not to be less than the $CEV_{ALARM}$ value, the microprocessor determines if the $CEV_{PREV}>CEV_{NEW}>CEV_{ALARM}$. If the $CEV_{PREV}>CEV_{NEW}>CEV_{ALARM}$, then the microprocessor records the decreasing CEV for this cycle and increments a CEV decreasing cycle counter or similar record. In effect, the microprocessor allows this relationship to be tested during every cycle; or to conserve resources, the test may be performed at some predetermined interval.

When the microprocessor senses a decreasing trend of CEV readings lasting for some predetermined number of cycles, the microprocessor infers a smoldering fire event profile and replaces the traditional $CEV_{ALARM}$ with a $CEV_{ALARM}$ optimized for a smoldering fire event. This is accomplished by the microprocessor selecting and employing a smaller $CEV_{DELTA}$. The smaller $CEV_{DELTA}$ causes the microprocessor to generate a higher $CEV_{ALARM}$ value enhancing the smoldering fire event sensitivity.

If the $CEV_{PREV}\leq CEV_{NEW}>CEV_{ALARM}$ the microprocessor continues to use a traditional fire profile with a traditional alarm threshold value providing greater resistance to nuisance false alarms. If at any point after adjusting the $CEV_{ALARM}$ to enhance smoldering event sensitivity, the $CEV_{PREV}\leq CEV_{NEW}>CEV_{ALARM}$ the microprocessor resets the decreasing cycle counter and selects the traditional $CEV_{DELTA}$, restoring the traditional $CEV_{ALARM}$ value for greater resistance to false alarms. The microprocessor may store, select from and employ any one of a plurality of $CEV_{DELTA}$ values to enhance or reduce the ionizations sensor package's or system's sensitivity to fit one or more predetermined smoke event profiles.

Figure 8:
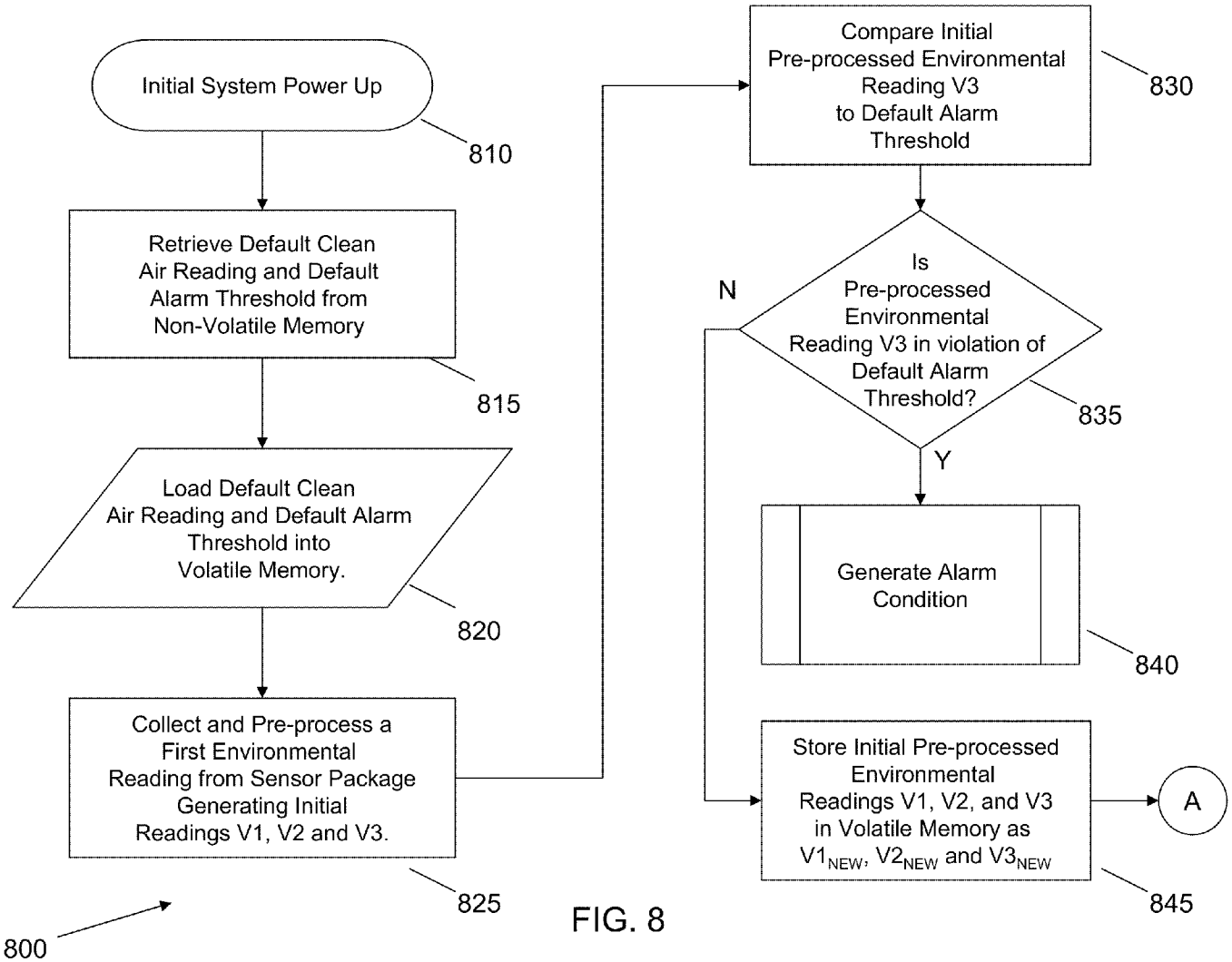
FIG. 8 is a flow diagram of an exemplarily embodiment of a method for providing ambient condition compensation in a hazardous condition detector.

Referring now to FIG. 8 with continued reference to FIG. 1, FIG. 8 shows a flow diagram of an exemplarily embodiment of a method for providing ambient condition compensation in a hazardous condition detector. This flow diagram illustrates the operation of the hazardous condition detector at the point of system power-up when the detector is deployed. The default clean air reading and the default alarm threshold values have previously been calibrated and loaded into the non-volatile memory 150 of the system 100.

As shown in FIG. 8, at system power up 810, the point at which the hazardous condition detector is connected to a power supply and deployed, the microprocessor 110 will retrieve the default clean air reading and default alarm threshold 815 from the non-volatile memory 150. The microprocessor 110 loads the default clean air reading and the default alarm threshold 820 into the volatile memory 140 of the system 100. Once the default values are loaded into the volatile memory 140, the system 100 goes into detection mode and collects the first of a plurality of environmental readings 825 to be evaluated by the microprocessor 110 for the existence of a hazardous condition. The microprocessor collects a first environmental reading from alarm means through the sensor package or directly from the sensor package.

The pre-processing step is then performed by the microprocessor. During pre-processing the microprocessor 110 generates initial V1, V2 and V3 values indicative of the readings collected from the sensor package 825 by employing the signal condition algorithm with three selected filtering constants. The filter constant used to generate V1 is typically the largest and is optimized to determine slow changes in the ambient environment and calculate the appropriate ambient condition adjustments to the selected threshold.

The filter constant used to generate V2 is optimized to generate a $CEV_{NEW}$ signal large enough to detect a trend of decreasing CEV signals to determine whether or not a threshold shift is appropriate. The filter constant used to generate V3 is optimized to generate a $CEV_{NEW}$ signal having a faster response time, making it more sensitive to abrupt changes in the conditions monitored by the ionizations sensor package.

The microprocessor selects and compares the initial pre-processed environmental reading V3 with the default alarm threshold to determine if the environmental reading is in violation of the alarm threshold 835. If the microprocessor determines that the pre-processed environmental reading V3 in violation of the default alarm threshold 835, the microprocessor with designate an alarm condition and the system will generate an alarm 840.

If the microprocessor determines that the pre-processed environmental reading V3 does not violate the default alarm threshold, the microprocessor 110 stores the initial pre-processed environmental readings V1, V2, and V3 in the volatile memory 140 as $V1_{NEW}$, $V2_{NEW}$ and $V3_{NEW}$ 845.

Figure 9:
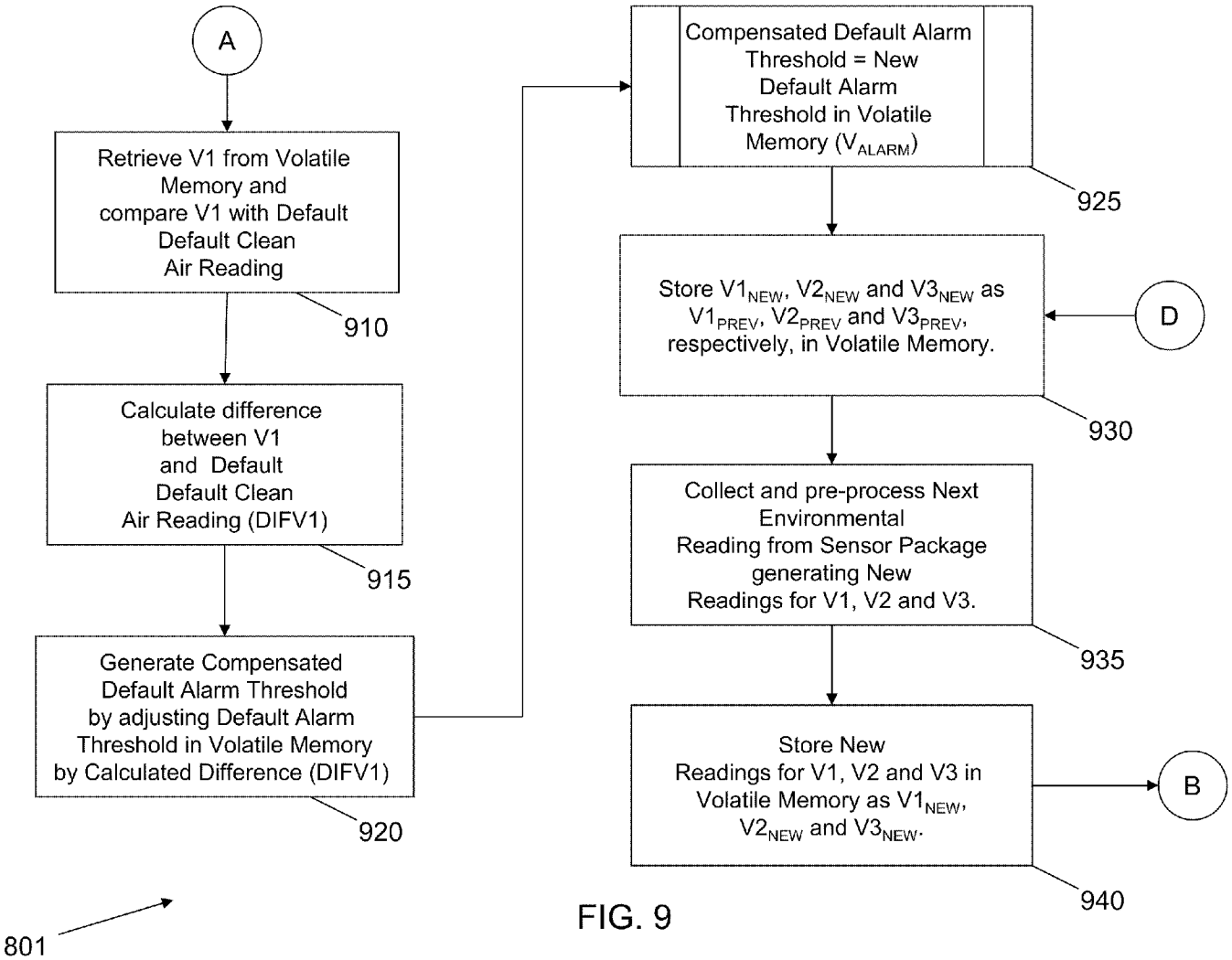
FIG. 9 is the continuation of the flow diagram of FIG. 8 illustrating an embodiment of a method for providing ambient condition compensation in a hazardous condition detector.

Referring now to FIG. 9, with continued reference to FIG. 1 and FIG. 8, the microprocessor 110 next retrieves the generated V1 reading from the volatile memory 140 and compares V1 with the default clean air reading 910. From this comparison the microprocessor 110 generates the DIFV1 value, which is the difference between V1 and the default clean air reading 915.

A compensated default alarm threshold is generated by adjusting the default alarm threshold currently stored in the volatile memory 140 by the calculated difference DIFV1 920. This compensated default alarm threshold is designated as the new default alarm threshold and stored in the volatile memory 140 as $V_{ALARM}$ 925. This compensated alarm threshold is used by the microprocessor 110 for future comparisons to determine if an alarm condition exists.

The microprocessor 110 stores $V1_{NEW}$, $V2_{NEW}$ and $V3_{NEW}$ in the volatile memory 140 as $V1_{PREV}$, $V2_{PREV}$ and $V3_{PREV}$, respectively 930. A new environmental reading is then collected from the sensor package and pre-processed by the microprocessor 110. The microprocessor 110 uses the signal conditioning algorithm to generate new readings for V1, V2 and V3 935. The system microprocessor 110 stores the newest readings for V1, V2 and V3 in the volatile memory 140 as $V1_{NEW}$, $V2_{NEW}$ and $V3_{NEW}$ 940.

Figure 10:
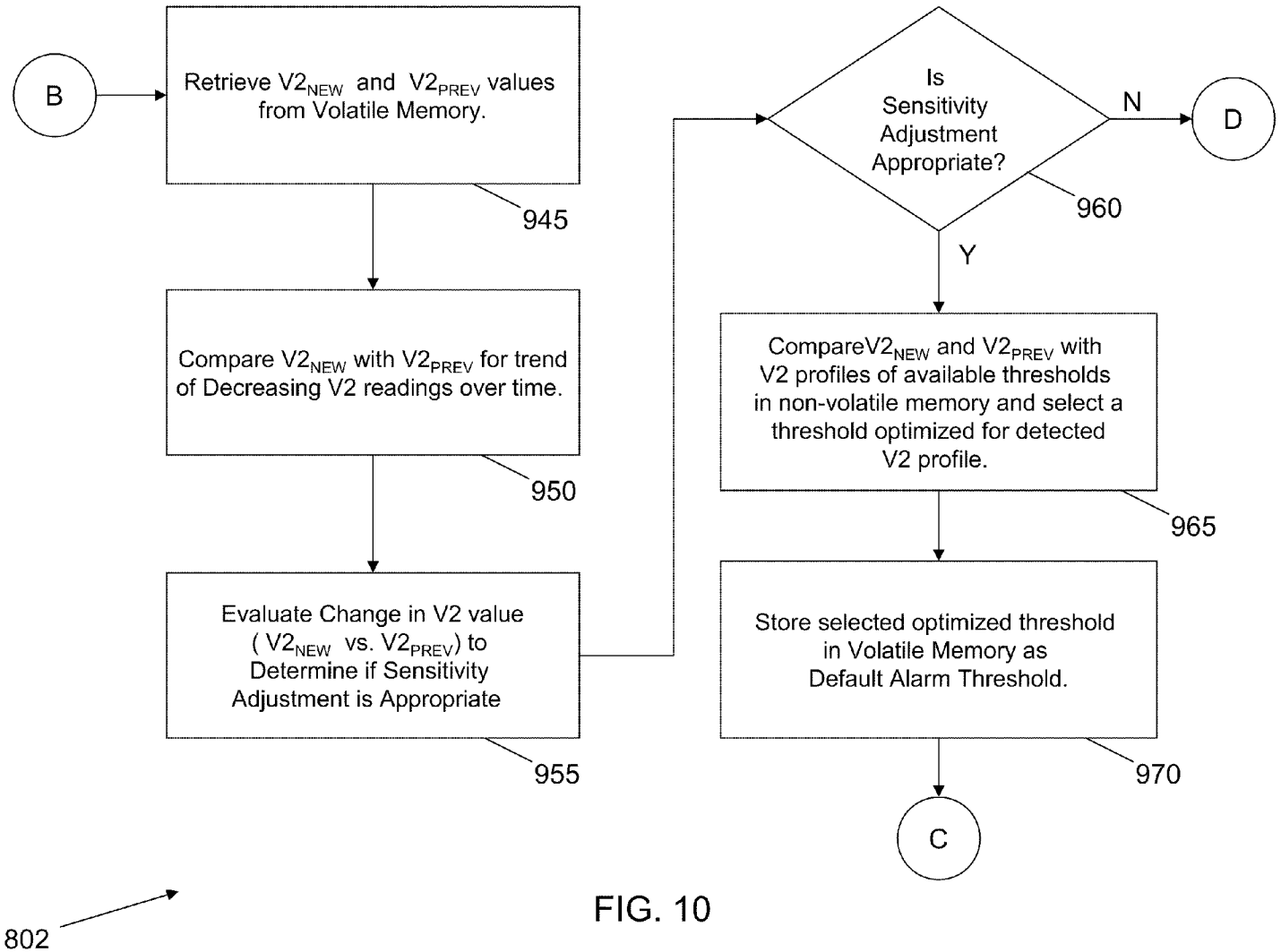
FIG. 10 is the continuation of the flow diagram of FIG. 8 and FIG. 9 illustrating an embodiment of a method for providing ambient condition compensation in a hazardous condition detector.

Referring now to FIG. 10 with continued reference to FIG. 1, FIG. 8 and FIG. 9, the microprocessor 110 retrieves the $V2_{NEW}$ and $V2_{PREV}$ values 945 from the volatile memory 140 and evaluates the $V2_{NEW}$ in view of the $V2_{PREV}$ values 950 looking for a trends of decreasing V2 readings as a function of time to determine if sensitivity adjustment is appropriate 955. The decreasing trend of voltage readings by the CEV is used by the microprocessor 110 to infer the existence of a smoldering fire condition and change select an alarm threshold optimized for a smoldering fire. Typically, a threshold shift will only occur when a predetermined number of V2 readings exhibit a decreasing trend. If the continuity of the decreasing trend is broken and the system is employing a smoldering threshold, the threshold with shift back to a traditional fire threshold.

When the microprocessor 110 determines that the sensitivity adjustment is not appropriate 960, the microprocessor stores $V1_{NEW}$, $V2_{NEW}$ and $V3_{NEW}$ in the volatile memory 140 as $V1_{PREV}$, $V2_{PREV}$ and $V3_{PREV}$, respectively, and collects the next environmental reading to pre-process and generate $V1_{NEW}$, $V2_{NEW}$ and $V3_{NEW}$ 930.

If the microprocessor 110 determines that the sensitivity adjustment is appropriate, the microprocessor 110 selects a new alarm threshold to employ, such as a smoldering threshold. The microprocessor 110 accomplishes this task by comparing $V2_{NEW}$ and $V2_{PREV}$ with the voltage profiles of a plurality of available thresholds stored in the 150 non-volatile memory, and selecting an appropriate threshold optimized for currently detected V2 profile 965. The profiles are typically associated with a threshold at the factory; however, they may be associated with a particular threshold in the field or at system initiation. The optimized threshold is stored in the volatile memory as the new default alarm threshold 970.

Figure 11:
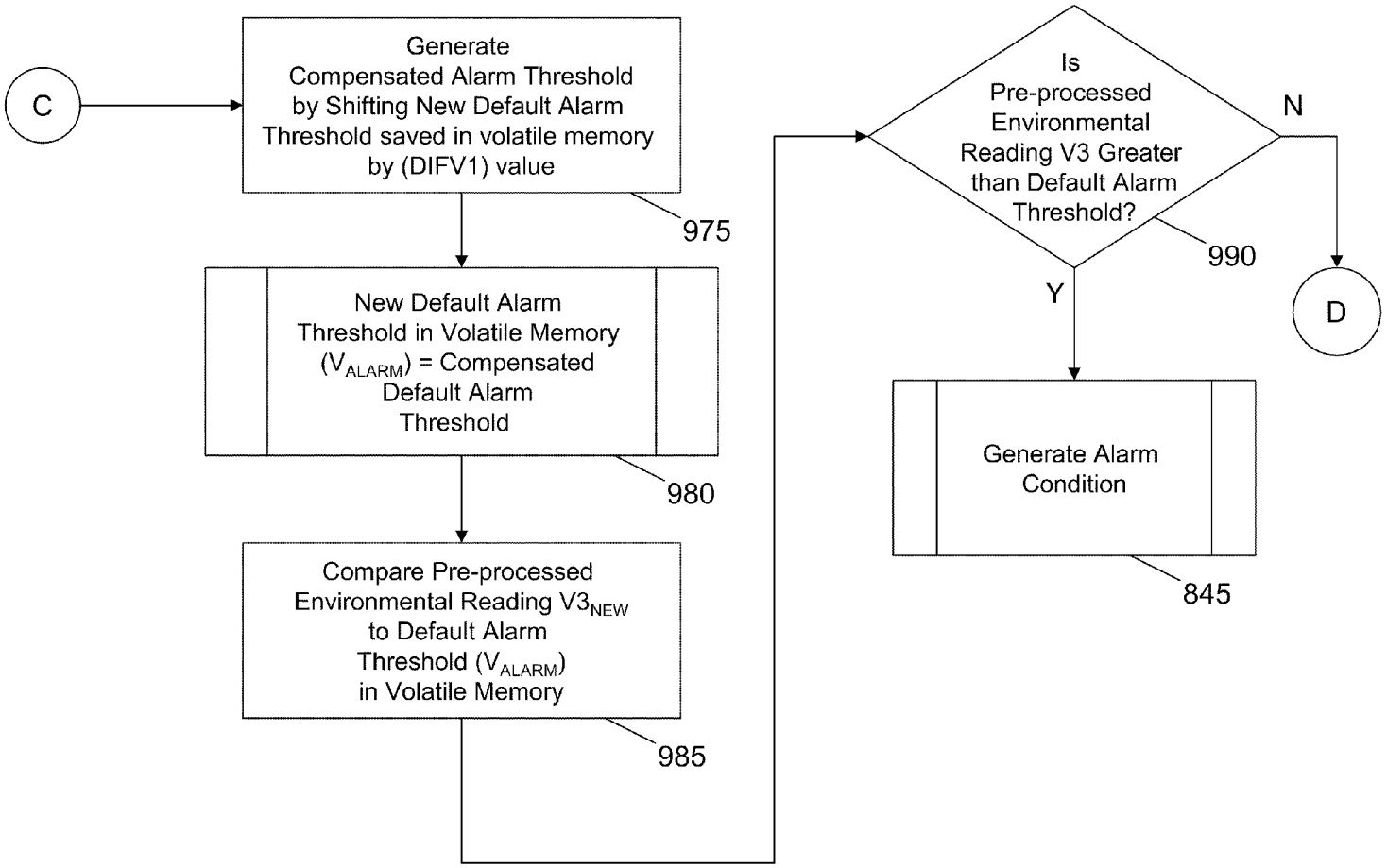
FIG. 11 is the continuation of the flow diagram of FIG. 8, FIG. 9 and FIG. 10 illustrating an embodiment of a method for providing ambient condition compensation in a hazardous condition detector
Figure 12:
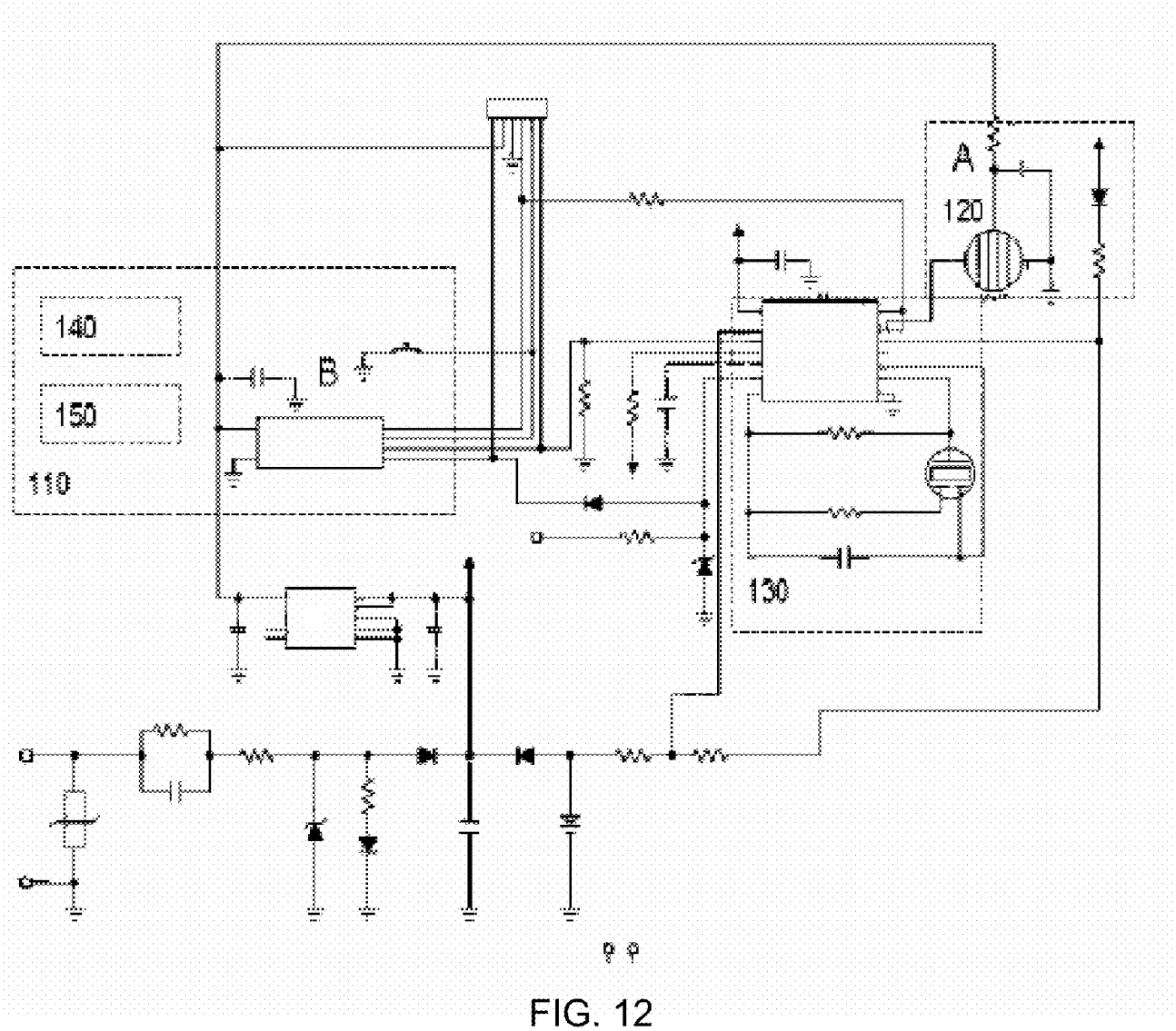
FIG. 12 is an exemplary schematic illustrating circuitry to achieve the invention using a smoke detector ASIC coupled directly to the sensor package.

Referring now to FIG. 11 with continued reference to FIG. 1, FIG. 9 and FIG. 10 the microprocessor 110 generates a compensated alarm threshold by shifting the new default alarm threshold saved in volatile memory 140 by the DIFV1 value 975 so that the new default alarm threshold in volatile memory ($V_{ALARM}$) is the compensated default alarm threshold 980. The microprocessor 110 then compares the pre-processed environmental reading $V3_{NEW}$ to the default alarm threshold ($V_{ALARM}$) 985 stored in the volatile memory 140, and if the pre-processed environmental reading V3 is found to be greater than the default alarm threshold 990 the microprocessor 110 generates an alarm condition and the system alarms 845.

When the pre-processed environmental reading V3 does not violate the default alarm threshold 990 the system stores $V1_{NEW}$, $V2_{NEW}$ and $V3_{NEW}$ as $V1_{PREV}$, $V2_{PREV}$ and V3PREV, respectively, in volatile memory 140 and collects the next environmental reading to generate $V1_{NEW}$ $V2_{NEW}$ and $V3_{NEW}$ 930.

In yet another embodiment, the hazardous condition detection system incorporates an energy savings feature. Specifically, the power is conserved by employing microprocessor a sleep mode wherein a periodic wake up signal is sent to the microprocessor through the sensitivity set pin of a typical smoke ASIC. This power conservation feature extends the operational life of battery powered units by a large margin. This is very significant in view of the widespread use of battery powered systems and the failure rate of these units due to depleted battery power. This is accomplished by employing the sensitivity pin of the ASIC as an external interrupt to wake up the microprocessor. The ASIC performs all other necessary features of a smoke detector such as communication, horn driving, low battery detect, and buffering of the smoke sensor signal.

Figure 15:
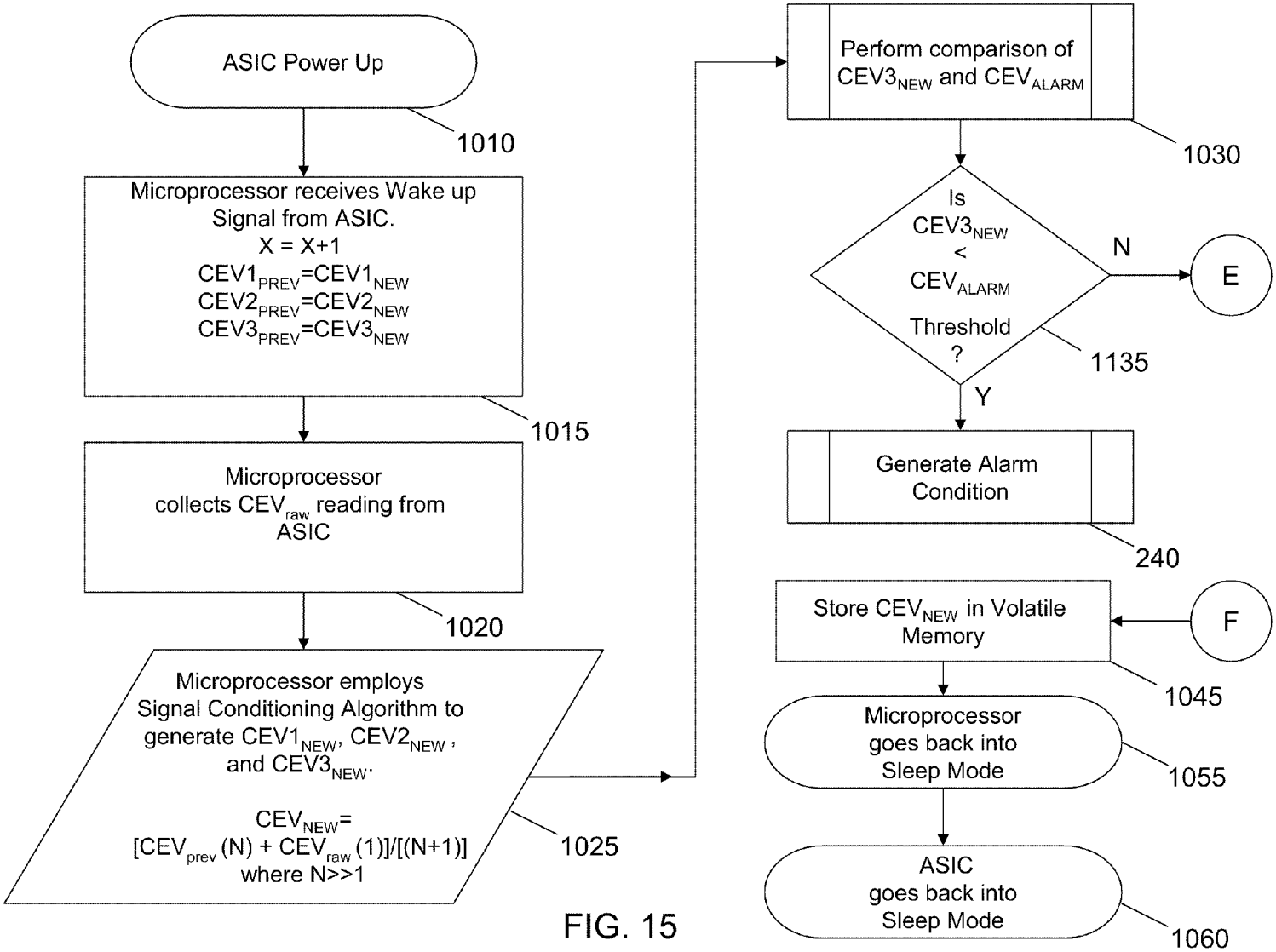
FIG. 15 is a flow diagram for an embodiment of an ionization type hazardous condition detector employing a power saving sleep feature.
Figure 16:
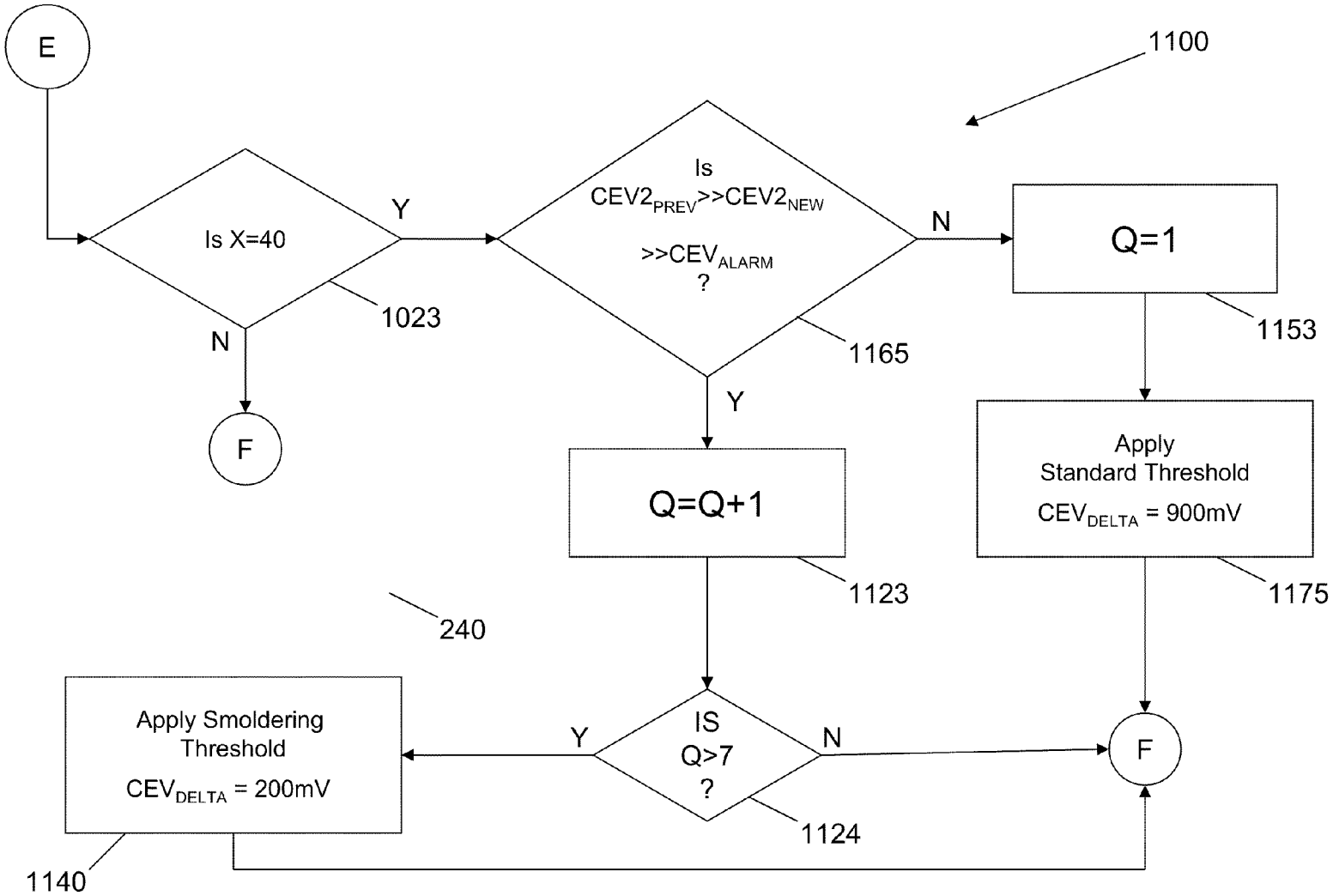
FIG. 16 is a flow diagram for an embodiment of an ionization type hazardous condition detector employing the wake up feature and an ionization optimization algorithm employing distinct alarm thresholds for different types of fire events.

FIG. 15 and FIG. 16 show flow diagrams for an example of an ionization type hazardous condition detector employing the wake up feature and the ionization optimization algorithm. The ASIC preferably controls the sensing/detection/alarm functions as well as the power management functions. The signal processing functions, including the variable threshold functions, are preferably controlled by the microprocessor. The ASIC typically functions as a slave unit feeding the microprocessor signal and receiving subsequent alarm instructions from the microprocessor. The ASIC's power management feature powers up/down the ASIC at a predetermined interval and is used to power up and power down the microprocessor.

Referring now to FIG. 15, with continued reference to FIG. 1 in the illustrated embodiment, the ASIC 130 powers up every 1.67 seconds and takes an ionization reading through the ionization sensor 1010. This reading is the $CEV_{RAW}$ reading and represents an unprocessed signal. On power up, the ASIC 130 sends a wake up signal to the microprocessor 1015. In response to the ASIC's wake up signal, the microprocessor 110 becomes active for a period of 10 milliseconds. In this 10 millisecond active period, the microprocessor 110 performs signal processing tasks and determines whether or not an alarm condition is present, or whether or not an alarm threshold shift is appropriate. In other embodiments, a smaller or larger temporal window may be employed to perform the signal processing tasks.

Upon wake up, the microprocessor 110 increments an iteration counter and sets $CEV_{PREV}=CEV_{NEW}$, as a power up initiation step 1015 prior to calculating the current $CEV_{NEW}$. In setting the $CEV_{PREV}$ to $CEV_{NEW}$ the microprocessor saves the previous set of conditioned $CEV_{NEW}$ signals into volatile memory 140. Next, the microprocessor 110 collects a $CEV_{RAW}$ reading 1020 from the ASIC 130 and employs a signal conditioning algorithm 1025 to the $CEV_{RAW}$ signal. This pre-processing step generates a set of $CEV_{NEW}$ values. The set of $CEV_{NEW}$ values includes at least a CEV1, CEV2, and CEV3 generated by employing varying levels of filtering, optimized for different comparison tasks, when the signal is conditioned. As discussed above the CEV1 value is optimized for determining the small shifts in the thresholding that vary with the ambient condition such as temperature and humidity and is not discussed in detail in this exemplarily embodiment. The CEV2 is optimized and selected for use in comparisons to determine whether or not a new smoldering threshold or a traditional fire event threshold is appropriate. The CEV3 is optimized and selected for comparisons used to evaluate whether or not a fire event exist.

Once the microprocessor 110 generates the set of $CEV_{NEW}$ values, which are the conditioned signal, the microprocessor 110 periodically compares selected $CEV_{NEW}$ signals from the set with the current $CEV_{ALARM}$ value. The microprocessor 110 typically stores the set of $CEV_{NEW}$ signals generated at the power up initiation step 1015 at periodic intervals but may store the set of $CEV_{NEW}$ signals at each wake up cycle.

The microprocessor 110 performs the comparison step 1030 when it compares the $CEV3_{NEW}$ and the $CEV_{ALARM}$ value by employing an ionization optimization algorithm 1100. The microprocessor 110 compares the $CEV3_{NEW}$ with the $CEV_{ALARM}$ at each wake up cycle or it may periodically compare the $CEV3_{NEW}$ and the $CEV_{ALARM}$. In the embodiment shown in FIG. 15, the CEV comparison is performed every 40 sleep/wake cycles 1023 or approximately every 70 seconds. Preferably, the microprocessor 110 periodically adjusts the currently selected $CEV_{ALARM}$ to compensate for minute changes in the ambient conditions. In one form of the invention, the selected $CEV_{ALARM}$ may be adjusted by ±50 mV at intervals of 5 sleep/wake cycles to compensate for temperature and humidity changes in the monitored space, while the CEV comparison for alarm determination and/or ionization optimization is performed every 40 sleep/wake cycles. In other embodiments the interval and magnitude of the $CEV_{ALARM}$ adjustment for ambient condition compensation may vary.

Referring now to FIG. 16, if the microprocessor 110 determines that the $CEV3_{NEW}<CEV_{ALARM}$ threshold 1135, an alarm condition is inferred to be present and the microprocessor 110 forces the ASIC 130 into an alarm condition, generating an alarm 240. If the $CEV3_{NEW}$ is determined not to be less than the $CEV_{ALARM}$ value, the microprocessor determines if the $CEV2_{PREV}>CEV2_{NEW}>CEV_{ALARM}$1165. If the $CEV2_{PREV}>CEV2_{NEW}>CEV_{ALARM}$, the microprocessor 110 records the decreasing $CEV2_{PREV}$ for this cycle and increments a CEV decreasing cycle counter 1123 or similar record.

When the microprocessor 110 senses a decreasing trend of $CEV2_{NEW}$ readings, evidenced by the $CEV2_{NEW}$ decreasing for seven consecutive cycles 1124, the microprocessor 110 infers a smoldering fire, selects and employs a lower alarm threshold differential value, $CEV_{DELTA}=200$ mV, 1140 to enhance the ionization detector's sensitivity.

If the $CEV2_{PREV}\leq CEV2_{NEW}>CEV_{ALARM}$, the microprocessor 110 continues to use the standard alarm threshold differential value, $CEV_{DELTA}=900$ mV, to maintain resistance to nuisance false alarms 1175. If the $CEV2_{NEW}$ does not reflect a continuous decrease at any point after selecting a $CEV_{DELTA}$ to enhance the detector's smoldering event sensitivity, the decreasing cycle counter is reset to one 1153, and the microprocessor reverts back to the standard alarm threshold differential value, $CEV_{DELTA}=900$ mV 1175, which provides optimized detection of the traditional fast flaming fires.

FIG. 8 shows an exemplary schematic diagram of circuitry employed to achieve the wake up feature of the instant invention using a smoke detector ASIC. The sensitivity set is typically used to adjust the sensitivity of the smoke detector by attaching resistors thereto. In the example embodiment, the sensitivity set is pin 13. pin 13 of this ASIC is attached to pin 4 of the microprocessor as seen in FIG. 8 point 'B'. Typically this pin is only active for 10 mS every 1.67 second period. When this pin is not active, it is placed on a high impedance state. When the pin is inactive the microprocessor goes into what can be described as a "halt" or "active halt" mode, minimizing the system's power consumption. When the pin is active, the microprocessor interrupt is extinguished and the microprocessor wakes. Since the microprocessor is not always active and consuming the system's power, extended operational life when dependent on battery power is realized compared to conventional configurations.

When pin 13 is active, the impedance is low allowing current flow to the microprocessor coupled to the pin. The current flow in pin 13 wakes the microprocessor and the microprocessor is active during the 10 mS period. During this 10 mS period the microprocessor retrieves/receives the sensor package measurements, evaluates the results, and determines if an alarm event exist. If an alarm event is determined to exist, the microprocessor forces pin 13 to go to a high voltage overriding the deactivation signal forcing the ASIC into an alarm mode. If no alarm event is detected by the microprocessor during the active period, the microprocessor does not override pin 13 and will return to sleep mode until the ASIC's next 10 mS active period.

Since the microprocessor spends a significant amount of time, corresponding to the ASIC's inactive period, in sleep mode a substantial power savings is realized. This conservation of battery power significantly extends the system's battery life.

In other embodiments the optimization of alarm thresholds, via preprocessing of the sensor package's output and optimizing the microprocessor's signal processing comparisons, as well as the energy conservation features set forth herein, may be employed to optimize the performance of other hazardous condition detectors such as photoelectric or gas detectors. This optimization technology may be employed to improve the efficiency of stand alone detectors and/or interconnected hazardous condition detection systems employed in residential and industrial structures or other enclosed environments.

Although specific embodiments of the invention have been described herein, it is understood by those skilled in the art that many other modifications Although specific embodiments of the invention have been described herein, it is understood by those skilled in the art that many other modifications and embodiments of the invention will come to mind to which the invention pertains, having benefit of the teaching presented in the foregoing description and associated drawings.

It is therefore understood that the invention is not limited to the specific embodiments disclosed herein, and that many modifications and other embodiments of the invention are intended to be included within the scope of the invention. Moreover, although specific terms are employed herein, they are used only in generic and descriptive sense, and not for the purposes of limiting the description invention.

The invention claimed is:

1. A microprocessor controlled hazardous condition detection system comprising:

a housing containing a sensor package, said sensor package containing sensors said sensors being exposed to an ambient environment and taking periodic readings of predetermined environmental conditions;

an alarm means associated with said sensor package and disposed in said housing;

a microprocessor electronically coupled to said alarm means and sensor package, said microprocessor having volatile and non-volatile memory, said non-volatile memory having an alarm differential value and a clean air default value stored therein;

wherein a default alarm threshold is determined by adding said differential value to said clean air default value;

wherein upon system power-up, said default alarm threshold is loaded into said volatile memory; said microprocessor receives periodic readings of predetermined environmental conditions from said sensor package stores said periodic readings in said volatile memory and generates at least a set of a first and a second conditioned sensor readings $CEV1_{NEW}$ and $CEV2_{NEW}$ for each received periodic reading, by calculating an average of a plurality of said periodic readings according to the relation $CEV_{NEW}=[CEV_{PREV}(N)+CEV_{RAW}(1)/N+1]$, where N is selected from a range of values>1, $CEV_{RAW}$ is a current periodic sensor reading and $CEV_{PREV}$ is a previously conditioned sensor reading and generates a new alarm threshold by shifting the default air alarm threshold loaded into said volatile memory by a value derived from the difference in the calculated average environmental reading and said clean air default value;

wherein upon detection of an ambient environmental condition outside of said alarm threshold stored in said volatile memory said microprocessor causes said alarm means to generate an alarm condition.

2. The system of claim 1, wherein said alarm differential value and said clean air default value are stored in said non-volatile memory at the point of manufacture.

3. The system of claim 1, wherein said sensor package comprises at least one ionization type sensor for detecting smoke.

4. The system of claim 1, wherein said sensor package comprises at least one gas sensor.

5. The system of claim 1, wherein said microprocessor shifts the default air alarm threshold loaded into said volatile memory by a value greater than the difference in the calculated average environmental reading and said clean air default value to decrease system sensitivity.

6. The system of claim 1 wherein said alarm means is coupled to said microprocessor through an ASIC sensitivity set pin, said microprocessor using said ASIC sensitivity set pin to synchronize microprocessor active and inactive periods with the active and inactive periods of said ASIC.

7. The system according to claim 1 where the microprocessor generates a set of a first, second and third conditioned sensor readings $CEV1_{NEW}$, $CEV2_{NEW}$ and $CEV3_{NEW}$ for each received periodic sensor reading, where N is selected from a range of values between $2^2$ to $2^{20}$ to generate each conditioned sensor reading, $CEV_{RAW}$ is a current periodic sensor reading and $CEV_{PREV}$ is a previously conditioned sensor reading.

8. The system according to claim 7 where the microprocessor preprocesses each received periodic sensor reading and generating a set of conditioned sensor readings including $CEV1_{NEW}$, $CEV2_{NEW}$ and $CEV3_{NEW}$ for each received periodic sensor reading characterized by and generating a $CEV1_{NEW}$ value according to the relation $CEV1_{NEW}=[CEV1_{PREV}(N)+CEV_{RAW}(1)]/[N+1]$, where N is approximately $2^{14}$, $CEV_{RAW}$ is a current periodic sensor reading and $CEV_{PREV}$ is a previously conditioned sensor reading generated using N as approximately $2^{14}$.

9. The system according to claim 7 further characterized in that the microprocessor preprocesses each received periodic sensor reading generating a set of conditioned sensor readings including $CEV1_{NEW}$, $CEV2_{NEW}$ and $CEV3_{NEW}$ for each received periodic sensor reading characterized by and generating a $CEV2_{NEW}$ value according to the relation $CEV2_{NEW}=[CEV2_{PREV}(N)+CEV_{RAW}(1)]/[N+1]$ where N is approximately $2^7$, $CEV_{RAW}$ is a current periodic sensor reading and $CEV_{PREV}$ is a previously conditioned sensor reading generated using N as approximately $2^7$.

10. The system according to claim 7 where the microprocessor preprocesses each received periodic sensor reading and generating a set of conditioned sensor readings including $CEV1_{NEW}$, $CEV2_{NEW}$ and $CEV3_{NEW}$ for each received periodic sensor reading characterized by and generating a $CEV3_{NEW}$ value according to the relation $CEV3_{NEW}=[CEV3_{PREV}(N)+CEV_{RAW}(1)]/[N+1]$, where N is approximately $2^2$, $CEV_{RAW}$ is a current periodic sensor reading and $CEV_{PREV}$ is a previously conditioned sensor reading generated using N as approximately $2^2$.

11. The system according to claim 1 where the first subset of accumulated conditioned sensor readings includes a $CEV2_{NEW}$ value generated by the microprocessor by according to the $CEV2_{NEW}=[CEV2_{PREV}(N)+CEV_{RAW}(1)]/[N+1]$, where N is selected from a range of values >1, $CEV_{RAW}$ is a current periodic sensor reading and $CEV2_{PREV}$ is a previously conditioned sensor reading.

12. The system according to claim 11 where the second subset of accumulated conditioned sensor readings includes a $CEV3_{NEW}$ value generated by the microprocessor by according to the $CEV3_{NEW}=[CEV3_{PREV}(N)+CEV_{RAW}(1)]/[N+1]$, where N is selected from a range of values >1 $CEV_{RAW}$ is a current periodic sensor reading and $CEV1_{PREV}$ is a previously conditioned sensor reading.

13. The system according to claim 12 where the third subset of accumulated conditioned sensor readings includes a $CEV1_{NEW}$ value generated by the microprocessor by according to the $CEV1_{NEW}=[CEV1_{PREV}(N)+CEV_{RAW}(1)]/[N+1]$, where N is selected from a range of values >1 $CEV_{RAW}$ is a current periodic sensor reading and $CEV1_{PREV}$ is a previously conditioned sensor reading.

14. A method for selecting an alarm threshold for a hazardous condition detector comprising the steps of:

selecting a first alarm threshold value as the current alarm threshold;

associating a second alarm threshold value with a predetermined set of environmental condition levels;

taking periodic readings of the environmental condition level in the ambient environment with an environmental condition sensor;

accumulating a plurality of the periodic readings of the environmental condition level in the ambient environment;

comparing a set of the accumulated readings of the environmental condition level with the predetermined set of environmental condition levels associated with the second alarm threshold value with a microprocessor;

designating the second alarm threshold value as the current alarm threshold if the accumulated readings of the environmental condition level are within the environmental condition levels specified in the predetermined set of environmental condition levels associated with the second alarm threshold;

comparing the current alarm threshold with a newest environmental condition level reading with the microprocessor;

designating an alarm event if the newest environmental condition level reading is greater than the current alarm threshold;

where the hazardous condition detector is an ionization detector and where the environmental condition levels are ionization levels, further including the steps of:

designating the first alarm threshold value as the current alarm threshold if the newest ionization level reading is less than the current alarm threshold but greater than or equal to the previous ionization level reading;

associating a third alarm threshold value with a second predetermined set of ionization levels;

comparing a set of the accumulated readings of the ionization level with the second predetermined set of ionization levels associated with the third alarm threshold value with a microprocessor; and designating the third alarm threshold value as the current alarm threshold if the accumulated readings of the ionization level are within the ionization levels specified in the second predetermined set of ionization levels associated with the third alarm threshold.

15. The method according to claim 14 further including the step of:

designating the first alarm threshold value as the current alarm threshold if the newest environmental condition level reading is less than the current alarm threshold but greater than or equal to the previous environmental condition level reading.

16. The method according to claim 15 further including the steps of:

associating a third alarm threshold value with a second predetermined set of environmental condition levels;

comparing a set of the accumulated readings of the environmental condition level with the second predetermined set of environmental condition levels associated with the third alarm threshold value with a microprocessor;

designating the third alarm threshold value as the current alarm threshold if the accumulated readings of the environmental condition level are within the environmental condition levels specified in the second predetermined set of environmental condition levels associated with the third alarm threshold.

17. The method according to claim 14 further including the steps of:

preprocessing each received periodic sensor reading, and generating a set of conditioned sensor readings for each periodic sensor reading received from the sensor package.

18. The method according to claim 14 further including the step of: conditioning each ionization reading received by removing a selected amount of noise and attenuation therefrom, and generating a $CEV_{NEW}$ value according to the relation $CEV_{NEW}=[CEV_{PREV}(N)+CEV_{RAW}(1)]/[N+1]$, where N is >>1 and is selected by the microprocessor to generate a set of conditioned readings each having an optimum signal to noise ratio for a particular processing step, $CEV_{RAW}$ is a current periodic sensor reading and $CEV_{PREV}$ is a previously conditioned sensor reading.

19. A method for selecting an alarm threshold for a hazardous condition detector comprising the method steps of:

selecting a first alarm threshold value as a current alarm threshold;

associating a second alarm threshold value with a predetermined set of sensor readings;

taking periodic readings of sensor levels associated with a condition in the ambient environment with a sensor;

conditioning each of the periodic readings of the sensor level associated with a condition in the ambient environment by reducing noise resident in the periodic reading by a selected degree to generate a conditioned reading;

accumulating a plurality of the conditioned readings of the sensor level associated with a condition in the ambient environment;

designating the second alarm threshold value as the current alarm threshold if the accumulated conditioned readings of the sensor level are within the sensor levels associated with the second alarm threshold;

comparing the current alarm threshold with the conditioned readings of the sensor level;

designating an alarm event if the conditioned sensor readings of the sensor level is greater than the current alarm threshold;

where the hazardous condition detector is an ionization detector and where the sensor levels are ionization levels, further including the steps of:

designating the first alarm threshold value as the current alarm threshold if the newest ionization level reading is less than the current alarm threshold but greater than or equal to the previous ionization level reading;

associating a third alarm threshold value with a second predetermined set of ionization levels;

comparing a set of the accumulated readings of the ionization level with the second predetermined set of ionization levels associated with the third alarm threshold value with a microprocessor; and designating the third alarm threshold value as the current alarm threshold if the accumulated readings of the ionization level are within the ionization levels specified in the second predetermined set of ionization levels associated with the third alarm threshold.

* * * * *